US009279316B2

(12) United States Patent
Roberts et al.

(10) Patent No.: US 9,279,316 B2
(45) Date of Patent: Mar. 8, 2016

(54) THERMALLY ASSISTED GRAVITY DRAINAGE (TAGD)

(71) Applicant: ATHABASCA OIL CORPORATION, Calgary (CA)

(72) Inventors: Bruce Roberts, Calgary (CA); Doug Beattie, Calgary (CA); Tarek Hamida, Calgary (CA)

(73) Assignee: ATHABASCA OIL CORPORATION, Calgary, Alberta (CA)

( * ) Notice: Subject to any disclaimer, the term of this patent is extended or adjusted under 35 U.S.C. 154(b) by 0 days.

(21) Appl. No.: 14/528,820

(22) Filed: Oct. 30, 2014

(65) Prior Publication Data

US 2015/0047833 A1 Feb. 19, 2015

Related U.S. Application Data

(63) Continuation-in-part of application No. 13/163,009, filed on Jun. 17, 2011, now Pat. No. 9,051,828.

(51) Int. Cl.
*E21B 36/00* (2006.01)
*E21B 43/24* (2006.01)
*E21B 43/30* (2006.01)

(52) U.S. Cl.
CPC ..... *E21B 43/24* (2013.01); *E21B 43/305* (2013.01)

(58) Field of Classification Search
CPC ..... E21B 36/00; E21B 43/26
USPC ..... 166/302, 57, 60, 61, 245, 50
See application file for complete search history.

(56) References Cited

U.S. PATENT DOCUMENTS

| | | | | |
|---|---|---|---|---|
| 5,016,709 | A * | 5/1991 | Combe | E21B 43/305 166/245 |
| 5,803,171 | A * | 9/1998 | McCaffery | E21B 43/16 166/245 |
| 7,004,247 | B2 | 2/2006 | Cole et al. | |
| 7,066,254 | B2 * | 6/2006 | Vinegar | E21B 36/04 166/245 |
| 7,562,706 | B2 | 7/2009 | Li et al. | |
| 7,673,681 | B2 | 3/2010 | Vinegar et al. | |
| 7,677,310 | B2 | 3/2010 | Vinegar et al. | |
| 7,681,647 | B2 | 3/2010 | Mudunuri et al. | |
| 8,381,815 | B2 | 2/2013 | Karanikas et al. | |
| 2011/0048717 | A1 | 3/2011 | Diehl et al. | |

FOREIGN PATENT DOCUMENTS

| | | |
|---|---|---|
| CA | 2120851 C | 8/1995 |
| WO | 2010107726 A2 | 9/2010 |

* cited by examiner

*Primary Examiner* — Kenneth L Thompson
(74) *Attorney, Agent, or Firm* — Heslin Rothenberg Farley & Mesiti P.C.; Victor A. Cardona, Esq.

(57) ABSTRACT

A method for producing bitumen or heavy oil from a reservoir, the method comprising: defining at least one lateral section of the reservoir for placement of patterns of heater wells above a producer well; placing the producer well at a substantially centered location at or adjacent to the bottom of the reservoir within each of the lateral sections; placing a triangular pattern of heater wells above the producer well; placing a regular or non-regular pentagonal pattern of heater wells, or a portion thereof, at or above the triangular pattern of heater wells; heating the reservoir with the triangular and pentagonal patterns of heater wells to conductively heat the reservoir and reduce the viscosity of the bitumen or heavy oil; and producing bitumen or heavy oil with the producer well.

20 Claims, 21 Drawing Sheets

Temperature

Viscosity

Temperature

Viscosity

THERMALLY ASSISTED GRAVITY DRAINAGE (TAGD)

CROSS-REFERENCE TO RELATED APPLICATIONS

This application is a continuation-in-part of U.S. application Ser. No. 13/163,009, filed Jun. 17, 2011, which is incorporated herein by reference in its entirety.

FIELD OF THE INVENTION

The present disclosure relates generally to recovery of hydrocarbons. More particularly, the present disclosure relates to thermal recovery of bitumen or heavy oil.

BACKGROUND OF THE INVENTION

As existing reserves of conventional light liquid hydrocarbons such as light crude oil are depleted and prices for hydrocarbon products continue to rise, new sources of hydrocarbons are desirable. Viscous hydrocarbons such as heavy oil and bitumen offer an alternative source of hydrocarbons with extensive deposits throughout the world. In general, hydrocarbons having an API gravity less than 22° are referred to as "heavy oil" and hydrocarbons having an API gravity less than 10° are referred to as "bitumen." Although recovery of heavy oil and bitumen present challenges due to their relatively high viscosities, there are a variety of processes that can be employed to recover such viscous hydrocarbons from underground deposits.

Many techniques for recovering heavy oil and bitumen use thermal energy to heat the hydrocarbons, thereby decreasing their viscosity and increasing their mobility within the formation. This enables the extraction and recovery of the hydrocarbons. Accordingly, such production and recovery processes may generally be described as "thermal" techniques. A steam-assisted gravity drainage (SAGD) operation is one thermal technique for recovering viscous hydrocarbons such as bitumen and heavy oil. SAGD operations typically employ two vertically spaced horizontal wells drilled into the reservoir. Steam is injected into the formation via the upper well, also referred to as the "injection well," to form a steam chamber that extends radially outward and upward from the injection well. Thermal energy from the steam reduces the viscosity of the viscous hydrocarbons, thereby enabling them to flow downward through the formation under the force of gravity. The mobilized hydrocarbons drain into the lower well, also referred to as the "production well." The hydrocarbons collected in the production well are produced to the surface with artificial lift techniques.

Other processes use conductor-in-conduit heat sources to mobilize the heavy oil and bitumen, such as the processes described in U.S. Pat. No. 7,004,247 to Cole et al.

Other examples of hydrocarbon recovery processes are described in U.S. Pat. No. 7,673,681 issued on Mar. 9, 2010 to Vinegar et al., U.S. Publication No. 2011/0048717 published on Mar. 3, 2011 to Diehl et al., PCT Publication No. WO 2010/107726 published on Sep. 23, 2010 to Al-Buraik, and Canadian Patent No. 2,120,851 issued on Aug. 22, 1995 to Yu et al.

SUMMARY OF THE INVENTION

In a first aspect, the present disclosure provides a method of producing bitumen or heavy oil from a reservoir including: providing a heater well in a first portion of the reservoir; providing a producer well in a second portion of the reservoir, the second portion being at a greater depth than the first portion; providing a reservoir heater in the heater well; operating the reservoir heater to conductively heat the reservoir and reduce the viscosity of the bitumen or heavy oil; and producing bitumen or heavy oil through the producer well.

In another embodiment, the method further includes providing a reservoir producer heater in the producer well and operating the reservoir producer heater to conductively heat the reservoir and reduce the viscosity of the bitumen or heavy oil.

In another embodiment, the method further includes providing a flow assurance heater in the producer well and operating the flow assurance heater to facilitate flow of bitumen or heavy oil in the producer well.

In some embodiments, the reservoir is heated to an average temperature of less than 300° C.

In some embodiments, the reservoir is heated to an average temperature of less than 250° C.

In some embodiments, the reservoir is heated to an average temperature of less than 200° C.

In some embodiments, the reservoir is heated to an average temperature of less than the thermal cracking temperature of the bitumen or heavy oil in the reservoir at reservoir conditions.

In some embodiments, the reservoir is heated to a temperature less than the saturated steam temperature at reservoir conditions.

In some embodiments, the reservoir is heated to an average temperature of between about 120° C. and about 160° C.

In some embodiments, the reservoir is heated to an average temperature of between about 135° C. and about 145° C.

In some embodiments, the reservoir is a clastic reservoir.

In some embodiments, the reservoir is a carbonate reservoir.

In some embodiments, the reservoir is a dolomite carbonate reservoir.

In some embodiments, the reservoir is a limestone carbonate reservoir.

In some embodiments, the reservoir is a karsted carbonate reservoir.

In some embodiments, the reservoir is a vuggy carbonate reservoir.

In some embodiments, the reservoir is a moldic carbonate reservoir.

In some embodiments, the reservoir is a fractured carbonate reservoir.

In a further aspect, the present disclosure provides a method of producing bitumen or heavy oil from a reservoir including: providing a heater well in a first portion of the reservoir; providing a producer well in a second portion of the reservoir, the second portion being at a greater depth than the first portion; heating the heater well to conductively heat the reservoir and reduce the viscosity of the bitumen or heavy oil; and producing bitumen or heavy oil through the producer well.

In certain embodiments, the method further includes heating the producer well to conductively heat the reservoir and reduce the viscosity of the bitumen or heavy oil.

In certain embodiments, the method further includes heating the producer well to facilitate flow of bitumen or heavy oil in the producer well.

In certain embodiments, the method further includes selecting a target average temperature and reducing heating of the heater well once the average temperature of the reservoir is substantially equal to the target average temperature to maintain the average temperature of the reservoir at the target average temperature without increasing the average temperature of the reservoir.

In certain embodiments, the method further includes selecting a target average temperature and reducing heating of the heater well once the average temperature of the reservoir is substantially equal to the target average temperature to maintain the average temperature of the reservoir at the target average temperature without increasing the average temperature of the reservoir, and the target average temperature is between about 120° C. and about 160° C.

In certain embodiments, the method further includes selecting a target average temperature and reducing heating of the heater well once the average temperature of the reservoir is substantially equal to the target average temperature to maintain the average temperature of the reservoir at the target average temperature without increasing the average temperature of the reservoir, and the target average temperature is between about 135° C. and about 145° C.

In certain embodiments, the method further includes controlling pressure during production to prevent an increase in pressure.

In certain embodiments, the method further includes controlling pressure during production to prevent an increase in pressure by drawing down pressure from the reservoir.

In certain embodiments, the method further includes controlling pressure during heating to prevent an increase in pressure.

In certain embodiments, the method further includes controlling pressure during heating to prevent an increase in pressure by producing fluids from the reservoir.

In a further aspect, the present disclosure provides a system for producing bitumen or heavy oil from a reservoir comprising: a heater well in a first portion of the reservoir; a producer well in a second portion of the reservoir, the second portion being at a depth greater than the first portion; and a heater in the heater wellbore for heating the reservoir.

In some embodiments, the system further includes a second heater in the producer wellbore for heating the reservoir.

In some embodiments, the system further includes a second heater in the producer wellbore for heating bitumen or heavy oil produced from the reservoir to maintain a selected viscosity of the bitumen or heavy oil in the producer well.

In some embodiments, the heater is an electric resistance heater.

In some embodiments, the heater is an electric resistance heater cable heater.

In some embodiments, the heater is a fluid exchange heater.

In a further aspect, the present disclosure provides a method of producing bitumen or heavy oil from a reservoir including conductively electrically heating the reservoir to lower the viscosity of bitumen or heavy oil in the reservoir, forming a mobilized column of bitumen or heavy oil; and producing the bitumen or heavy oil below the mobilized column of bitumen or heavy oil.

In some embodiments, the method further includes heating an upper portion of the reservoir, the upper portion of the reservoir laterally offset from the mobilized column.

In a further aspect, the present disclosure provides a method of producing bitumen or heavy oil from a reservoir comprising: a) providing a horizontal producer well adjacent to a lower boundary of a cross-sectional area of the reservoir and substantially centered between two vertical no-flow pattern boundaries within a cross-sectional area of the reservoir; b) providing a plurality of vertically distributed rows of horizontal heater wells in the reservoir above the producer well, the plurality of rows including a first row with a single aligned heater well substantially vertically aligned and parallel with the producer well and a second row above the first row including at least two offset heater wells laterally offset and substantially equidistant from the producer well; c) activating the heater wells to conductively heat the reservoir and reduce the viscosity of the bitumen or heavy oil; d) allowing the bitumen or heavy oil to drain by gravity into the producer well; and e) producing the bitumen or heavy oil with the producer well.

In some embodiments, the method further comprises providing a reservoir producer heater in the producer well and operating the reservoir producer heater to conductively heat the reservoir and reduce the viscosity of the bitumen or heavy oil.

In some embodiments, the method further comprises providing a reservoir producer heater in a vertical section of the producer well and operating the reservoir producer heater to facilitate flow of the bitumen or heavy oil in the producer well upstream to the well head.

In some embodiments, the reservoir is heated to an average temperature of less than the thermal cracking temperature of the bitumen or heavy oil in the reservoir at reservoir conditions.

In some embodiments, the reservoir is heated to a temperature less than the saturated steam temperature at reservoir conditions.

In some embodiments, the reservoir is heated to an average temperature of between about 120° C. and about 160° C.

In some embodiments, the reservoir is heated to an average temperature of between about 135° C. and about 145° C.

In some embodiments, the reservoir is a clastic reservoir.

In some embodiments, the reservoir is a carbonate reservoir.

In some embodiments, the reservoir is a dolomite reservoir.

In some embodiments, the reservoir is a limestone reservoir.

In some embodiments, the reservoir is a karsted reservoir.

In some embodiments, the reservoir is a vuggy reservoir.

In some embodiments, the reservoir is a moldic reservoir.

In some embodiments, the reservoir is a fractured reservoir.

In some embodiments, the method further comprises selecting a target average temperature; and reducing heating of the heater wells once the average temperature of the reservoir is substantially equal to the target average temperature to maintain the average temperature of the reservoir at the target average temperature without increasing the average temperature of the reservoir.

In some embodiments, the target average temperature is between about 120° C. and about 160° C.

In some embodiments, the target average temperature is between about 135° C. and about 145° C.

In some embodiments, the method further comprises controlling pressure during production to prevent an increase in pressure due to thermal expansion of in situ fluids.

In some embodiments, the pressure is controlled by drawing down pressure from the reservoir.

In some embodiments, the plurality of vertically distributed rows of horizontal heater wells further includes at least one additional row with a single aligned heater well substantially aligned with and parallel to the producer well, to keep the area near the producer sufficiently warm to allow drainage of the bitumen or heavy oil into the producer well and at least one additional row including at least two offset heater wells laterally offset and substantially equidistant from the producer well.

In some embodiments, the rows with a single aligned heater well alternate with the rows of offset heater wells.

In some embodiments, the plurality of vertically distributed rows of horizontal heater wells includes at least two rows with a single aligned heater well and at least two rows with offset heater wells.

In some embodiments, the rows with an aligned heater well alternate with the rows of offset heater wells.

In some embodiments, the distance between the two offset heater wells of the same row varies among different rows of offset heater wells.

In some embodiments, at least one row of offset heater wells includes one offset heater well located substantially at or adjacent to each no-flow vertical boundary of the cross-sectional area of the reservoir.

In some embodiments, at least one row of offset heater wells further includes a heater well substantially laterally aligned with the producer well, to provide sufficient heating to promote drainage of the bitumen or heavy oil above the producer well.

In some embodiments, there is a repeating pattern of offset and aligned heater wells.

In some embodiments, the plurality of rows of heater wells includes three rows of heater wells with one aligned heater well row and two offset heater well rows.

In some embodiments, the three rows of heater wells follows a pattern wherein: the first row above the producer well includes a single aligned heater well, the second row above the producer well includes two offset heater wells, and the third row above the producer well includes two offset heater wells and a single aligned heater well.

In some embodiments, the vertical distance between adjacent rows is between about 8 m to about 15 m.

In some embodiments, the distance between offset heater wells in the same row is between about 12 m to about 40 m.

In some embodiments, the reservoir has a thickness of about 40 m.

In some embodiments, the plurality of rows of heater wells includes five rows of heater wells with three aligned heater well rows and two offset heater well rows.

In some embodiments, the five rows of heater wells follows a pattern wherein: the first row above the producer well includes a single aligned heater well, the second row above the producer well includes two offset heater wells, the third row above the producer well includes a single aligned heater well, the fourth row above the producer well includes two offset heater wells, and the fifth row above the producer well includes a single aligned heater well.

In some embodiments, the vertical distance between adjacent rows is between about 2 m to about 15 m.

In some embodiments, the distance between offset heater wells in the same row is between about 12 m to about 50 m.

In some embodiments, the reservoir has a thickness of about 60 m.

In some embodiments, the plurality of rows of heater wells includes six rows of heater wells with three aligned heater well rows and three offset heater well rows.

In some embodiments, the six rows of heater wells follows a pattern wherein: the first row above the producer well includes a single aligned heater well, the second row above the producer well includes two offset heater wells, the third row above the producer well includes a single aligned heater well, the fourth row above the producer well includes two offset heater wells, the fifth row above the producer well includes a single aligned heater well, and the sixth row above the producer well includes two offset heater wells.

In some embodiments, the vertical distance between adjacent rows is between about 4 m to about 14 m.

In some embodiments, the distance between offset heater wells in the same row is between about 12 m to about 50 m.

In some embodiments, the reservoir has a thickness of about 80 m.

In some embodiments the reservoir has a thickness ranging between about 40 m to about 80 m.

In some embodiments, the heater wells are heated by an electric resistance cable heater, a fluid exchange heater, hot water, steam, oil, molten salts, or molten metals.

In some embodiments, step c) generates gas through solution gas evolution and connate water vaporization to replace voidage created by step e).

In some embodiments, step d) further comprises injecting gas into a zone overlying the reservoir.

In a further aspect, the present disclosure provides a method for producing bitumen or heavy oil from a reservoir, the method comprising: a) defining at least one lateral section of the reservoir for placement of patterns of heater wells above a producer well; b) placing the producer well at a substantially centered location at or adjacent to the bottom of the reservoir within each of the lateral sections; c) placing a triangular pattern of heater wells above the producer well; d) placing a regular or non-regular pentagonal pattern of heater wells, or a portion thereof, at or above the triangular pattern of heater wells; e) heating the reservoir with the triangular and pentagonal patterns of heater wells to conductively heat the reservoir and reduce the viscosity of the bitumen or heavy oil; and f) producing bitumen or heavy oil with the producer well.

In some embodiments, the triangular pattern is arranged with a lowermost vertex located above and substantially aligned with the producer well and the heater wells of the remaining two higher vertices of the triangular pattern are contained within the boundaries of the lateral section at substantially the same level above the lowermost vertex of the triangular pattern.

In some embodiments, an additional heater well is placed substantially centrally within the pentagonal pattern.

In some embodiments, the width of the lateral section is between about 35 m to about 65 m.

In some embodiments, the reservoir thickness is less than about 50 m and the pentagonal pattern includes, as its lowest side, the heater wells of the two higher vertices of the triangular pattern and wherein the adjacent vertices of the pentagonal pattern extending laterally from the lowest side are located at or adjacent to the boundaries of the lateral section.

In some embodiments, the pentagonal pattern is a complete regular or non-regular pentagonal pattern and the apex of the pentagonal pattern is substantially aligned with the producer well.

In some embodiments, the bitumen or heavy oil drains by gravity from an upper portion of the lateral section into the producer well in a generally triangular profile.

In some embodiments, the reservoir thickness is greater than about 50 m and the pentagonal pattern is elevated above the triangular pattern and oriented with its lowermost vertex substantially aligned with the heater well.

In some embodiments, an additional heater well is placed substantially centrally within the pentagonal pattern.

In some embodiments, the distance between the top of the triangular pattern and the lowermost vertex of the pentagonal pattern is between about 2 m to about 20 m.

In some embodiments, the adjacent vertices of the pentagonal pattern extending laterally from the lowermost vertex are located at or adjacent to the boundaries of the lateral section.

In some embodiments, the pentagonal pattern is a complete pentagonal pattern with uppermost vertices contained within the boundaries of the lateral section.

In some embodiments, the bitumen or heavy oil drains vertically by gravity from an upper portion of the lateral section into the producer well in the pentagonal pattern which narrows into radial inflow in the triangular pattern.

In some embodiments, reservoir thickness exceeds 100 m and additional successively elevated regular or non-regular pentagonal patterns of heater wells are placed above the pentagonal pattern located above the triangular pattern.

In some embodiments, an additional heater well is placed substantially centrally within each of the pentagonal patterns.

In some embodiments, the bitumen or heavy oil drains vertically by gravity from an upper portion of the lateral section into the producer well which narrows into radial inflow in the pentagonal pattern located above the triangular pattern.

In some embodiments, at least one higher pentagonal pattern is arranged such that it shares two vertices with the preceding lower pentagonal pattern.

In a further aspect, the present disclosure provides a method for producing bitumen or heavy oil from a reservoir, the method comprising: a) dividing at least a portion of the reservoir into a plurality of lateral sections; b) placing a producer well at a substantially centered location at or adjacent to the bottom of the reservoir within each of the lateral sections; c) placing a triangular pattern of heater wells above each producer well; d) placing a regular or non-regular pentagonal pattern of heater wells, or a portion thereof, at or above each triangular pattern of heater wells; e) heating the reservoir with the triangular and pentagonal patterns of heater wells to conductively heat the reservoir and reduce the viscosity of the bitumen or heavy oil; and f) producing bitumen or heavy oil with the producer well of each lateral section.

In some embodiments, the method further comprises the step of: g) placing a second pentagonal pattern of heater wells, or a portion thereof, at or above the pentagonal pattern of heater wells placed in step d).

In some embodiments, at least one heater well of the pentagonal pattern of heater wells of one lateral section is shared by an adjacent pentagonal pattern of heater wells in an adjacent lateral section.

Other aspects and features of the present disclosure will become apparent to those ordinarily skilled in the art upon review of the following description of specific embodiments in conjunction with the accompanying figures.

BRIEF DESCRIPTION OF THE DRAWINGS

Various aspects of the invention will now be described with reference to the figures. For the purposes of illustration, components depicted in the figures are not necessarily drawn to scale. Instead, emphasis is placed on highlighting the various contributions of the components to the functionality of various aspects of the invention.

DETAILED DESCRIPTION OF THE INVENTION

Generally, the present disclosure provides a process, method, and system for recovering hydrocarbons from a reservoir. A number of possible alternative features are introduced during the course of this description. It is to be understood that, according to the knowledge and judgment of persons skilled in the art, such alternative features may be substituted in various combinations to arrive at different embodiments of the present invention.

Thermally-Assisted Gravity Drainage (TAGD)

Thermal Assisted Gravity Drainage (TAGD) is an in situ recovery process for production of viscous hydrocarbons such as bitumen or heavy oil. Less viscous hydrocarbons may be produced with the bitumen or heavy oil. TAGD is applicable to production of bitumen or heavy oil from either clastic or carbonate reservoirs. Carbonate reservoirs include limestone or dolomite, and may be any combination of vuggy, moldic, karsted, or fractured. More generally, TAGD is applicable to any formation wherein it is advantageous to transfer thermal energy to the formation.

Figure 1:
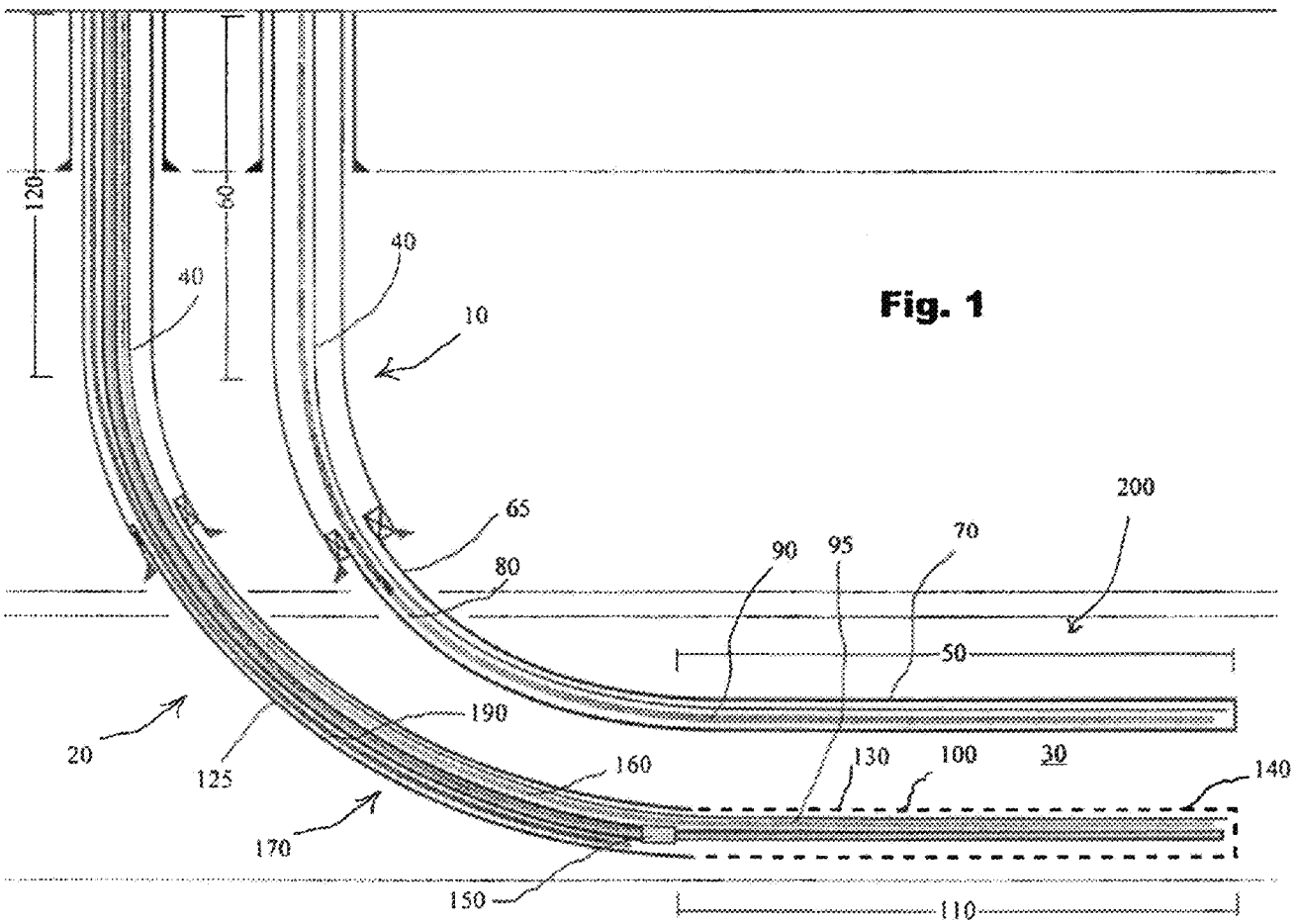
FIG. 1 is a schematic of a heater well and a producer well arranged in a TAGD pattern.

FIG. 1 is a schematic of a heater well 10 and a producer well 20 (collectively "wells") arranged in a TAGD pattern in a bitumen or heavy oil reservoir 30. As used herein, the reservoir 30 refers to that portion of a bitumen or heavy oil reservoir within a pattern as defined below (for example, any of the patterns illustrated in FIGS. 3-9).

In the particular embodiment shown in FIG. 1, the producer well 20 is located below the heater well 10 and may be located near the base of the reservoir 30. The heater well 10 may be between about 5 m and about 15 m above the producer well 20. An instrument string 40 may be present within each of the wells. The instrument string 40 may include a pressure sensor, a temperature sensor, both, or other instruments.

The heater well 10 includes a substantially horizontal heater well section 50 and a substantially vertical heater well section 60 joined by a heater well heel 65. The substantially vertical heater well section 60 joins the substantially horizontal heater well section 50 with a wellhead (not shown). The substantially horizontal heater well section 50 includes a heating zone 70. The heating zone 70 may have a length substantially equal to the length of the substantially horizontal heater well section 50. In one illustrative example, the heating zone 70 is about 1600 m in length. The heater well 10 is cased and hydraulically isolated from the reservoir 30.

A reservoir heater 80 is located in the heater well 10. The reservoir heater 80 includes a heating section 90 for transferring thermal energy to the reservoir 30. The heating section 90 defines the heating zone 70. In one illustrative example, the heating section 90 is about 1600 m in length.

The producer well 20 includes a substantially horizontal producer well section 110 and a vertical producer well section 120 joined by a producer well heel 125. The vertical producer well section 120 joins the substantially horizontal producer well section 110 with a wellhead (not shown). The substantially horizontal producer well section 110 includes a production zone 130. The producer well 20 is cased and hydraulically isolated from the reservoir 30 except at the production zone 130. The producer well 20 is completed in the production zone 130 with, for example, perforations, screens, a slotted liner 140 or other fluid inlet in the production zone 130. An artificial lift system, for example a pump 150, such as a rod pump, progressing cavity pump, or electric submersible pump, is provided in the producer well 20 to carry bitumen or heavy oil to the surface.

A reservoir producer heater 160 may be present in the producer well 20. A producer well 20 including a reservoir producer heater 160 functions as both a producer well 20 and a heater well 10, and is referred to below as a heater producer well 170. The reservoir producer heater 160 performs the same functions as the reservoir heater 80, providing thermal energy to the reservoir 30 along a producer heater heating section 95. The producer heater heating section 95 defines a producer heating zone 100. The producer heating zone 100 and the production zone 130 may be co-extensive. The producer heating zone 100 may have a length substantially equal to the length of the substantially horizontal producer well section 110. In one illustrative example, the producer heating zone 100 is about 1600 m in length.

A flow assurance heater 190 may be present in the vertical producer well section 120. The flow assurance heater 190 facilitates flow of bitumen or heavy oil within the producer well 20 by maintaining the temperature (and thus limiting the viscosity) of the bitumen or heavy oil. Thermal energy output of the flow assurance heater 190 may be uniform per unit length from the producer well heel 125 to the wellhead. The heater producer well 170 may include both the reservoir producer heater 160 and the flow assurance heater 190. A producer well 20 including the flow assurance heater 190, but lacking the reservoir producer heater 160, is not a heater producer well 170.

Each of the reservoir heaters 80, the reservoir producer heater 160, and the flow assurance heater 190 (collectively "heaters") may be of any type adapted for use in a well. Any of the heaters may be elongate to facilitate placement in the wells. Any of the heaters may be an electric resistance heater, for example a mineral insulated three-phase heater, for example a rod heater or cable heater. The electric resistance heater may be capable of accommodating medium voltage levels, for example from 600 V to 4160 V phase to phase.

Any of the heaters may be a heat exchanger that transfers thermal energy to the reservoir 30 by circulation of heat transfer fluid such as hot water, steam, oil (including synthetic oil), molten salts, or molten metals.

Heating

Thermal energy is transferred from the reservoir heater 80 or reservoir producer heater 160 to the reservoir 30 by conductive heating. The reservoir 30 is heated to an average temperature at which the viscosity of heavy oil or bitumen is low enough for the heavy oil or bitumen to flow by gravity to the producer well 20 or heater producer well 170. The viscosity of bitumen or heavy oil may be lowered, for example, to between about 50 cP and about 200 cP.

Figure 2:
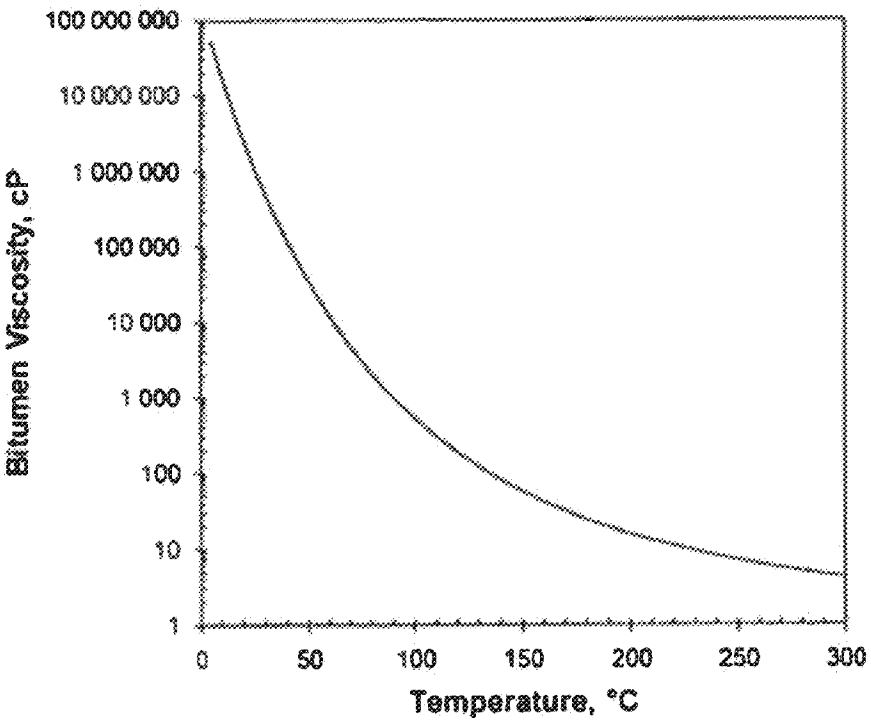
FIG. 2 is a plot of viscosity as a function of temperature for Leduc bitumen.

FIG. 2 is a plot of the viscosity of Leduc bitumen versus temperature. The data in FIG. 2 was applied to a simulation prepared with a commercially-available reservoir simulator (Computer Modeling Group (CMG)—STARS). A significant decrease in viscosity of Leduc bitumen occurs when the temperature of the bitumen is increased from 11° C. to between about 120° C. and about 160° C. Dead oil viscosity is reduced from about 14 million cP at an initial reservoir temperature of 11° C. to about 80 cP at 140° C. At 140° C., the bitumen or heavy oil is sufficiently mobile to drain downward to the producer well 20 or heater producer well 170 by gravity.

The reservoir heater 80 and the reservoir producer heater 160 are operated to transfer sufficient thermal energy to the reservoir 30 to increase the average temperature of the reservoir 30 to a target average temperature of between about 120° C. and about 160° C. This is done to maximize the energy efficiency of the process, and utilize the least amount of energy to recover the hydrocarbon effectively. While the reservoir 30 as a whole may average between about 120° C. and about 160° C., there may be near heater zones 180 (See for example FIG. 11) of the heater wells 10 and heater producer wells 170 with an average temperature of up to about 250° C. The near heater zones 180 are modeled as one meter blocks extending along the length of the heating zone 70, and for a heater producer well 170, at least a portion of the production zone 130.

TAGD may be applied to raise the average temperature of the reservoir 30 to between about 120° C. and about 160° C. An average temperature of about 140° C. provided favorable economics. At significantly lower average temperatures, for example about 100° C., production rates are too low to be economical. At significantly higher average temperatures, for example about 180° C., the resulting increase in the production rate does not justify the required increase in energy input required to raise the reservoir 30 to the higher average temperature. In addition, heating the reservoir 30 to between about 120° C. and about 160° C. avoids other potentially undesirable effects associated with higher average temperatures, such as increased $H_2S$ or $CO_2$ production, and in some cases, thermal cracking of bitumen or heavy oil.

During heating, the reservoir pressure may be monitored and controlled. Pressure may be controlled to remain below a selected value by reducing transfer of thermal energy to the reservoir 30 or by producing bitumen, heavy oil, water, vapours, or other fluids from the reservoir 30.

Well Spacing

The spacing of the heater wells 10 and producer wells 20 is set to realize the economical production of hydrocarbons. Substantially horizontal heater well sections 50 may be spaced as close as between about 5 m and about 40 m apart from each other and from substantially horizontal producer well section 110. The following performance metrics are relevant to optimization of the spacing of the heater wells 10 and producer wells 20: oil production profile (oil production rate versus time), overall recovery factor (fraction of original oil in place (OOIP) produced), energy ratio (ratio of energy supplied to the reservoir 30 to the heating value of the produced bitumen or heavy oil), and capital cost.

The process of constructing certain embodiments of TAGD well patterns in a hydrocarbon-containing formation may make use of combinations of building block geometries, or portions thereof, some of which may be arranged in different orientations. In such embodiments, one building block is a triangular pattern of heater wells which is placed immediately above the producer well (depicted with a small triangle symbol) which is substantially centrally located within a repeating pattern at the base of the reservoir. The triangular pattern is illustrated with short-dashed lines between the circles representing cross sections of heater wells in each of FIGS. 3-5 and FIG. 9. This triangular pattern is also seen in immediately above the producer well 170 in each of FIGS. 6-8. The primary function of the triangular pattern is to ensure proper inflow of heated hydrocarbons into the producer well.

Also shown with short-dashed lines between the circles representing cross sections of heater wells in each of FIGS. 3-5 and FIG. 9 is a pentagonal pattern. The pentagonal pattern is employed to minimize the number of heater wells in a two-dimensional space and to take advantage of thermal superpositioning to achieve a uniform lateral temperature distribution. This second pentagonal building block may be provided in repeating units, and/or portion(s) thereof, in similar or different orientations, as described hereinbelow, for the purpose of heating the majority of a defined longitudinal section of a reservoir. The pentagon may be laterally distorted (i.e. non-regular) from the equilateral (regular) pentagon geometry shown in FIGS. 3-5 and FIG. 9 in order to optimize drainage volume. An example of such a non-regular pentagon is seen, for example, in FIG. 8 with two wells 10 spaced apart from each other by 50 m.

Figure 3:
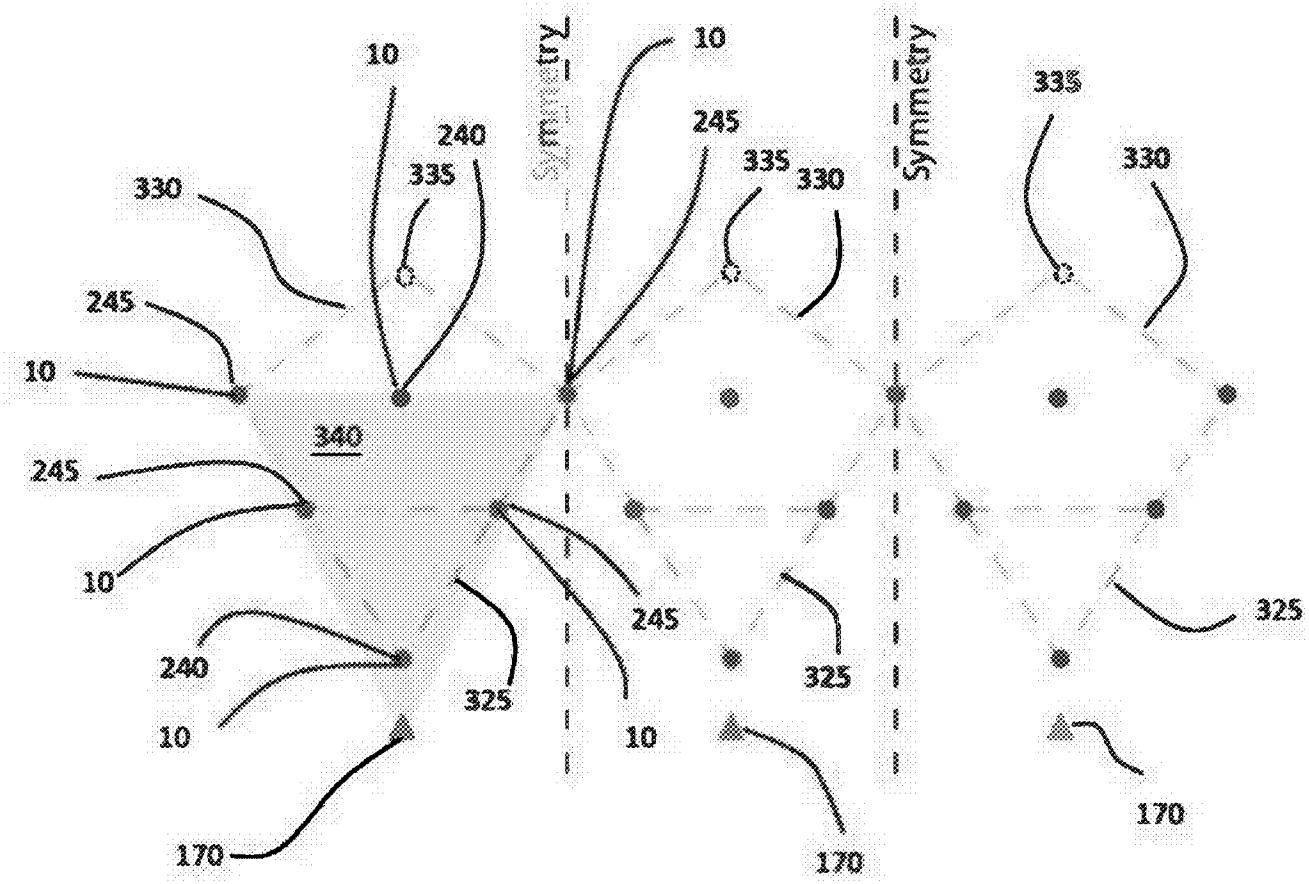
FIG. 3 is a cross section of three adjacent identical heater well patterns showing one arrangement of a pattern with a triangular building block and a partial pentagonal building block with one side shared between the two building blocks.

A series of adjacent identical cross sectional well patterns is shown in FIG. 3. To preserve clarity, the heater wells 10 are labelled only in the left-most pattern. Each pattern has a producer well 170, a triangular pattern 325 of heater wells 10 located immediately above the producer well 170 and a pentagonal pattern 330 of heater wells 10 which shares its lower side with the upper side of the triangular pattern 325. In this particular pattern, the apex of the pentagonal pattern is a vacant space 335 where a heater well would be located if drainage volume was desired at that location (therefore the pentagonal pattern is a "partial" pentagonal pattern. The triangular pattern includes a single aligned heater well 10, 240 (vertically aligned with the producer well 170) and two offset heater wells, 10, 245. The pentagonal pattern includes four offset heater wells 10, 245 and a single centrally-located aligned heater well 10, 240. The drainage volume provided by this overall pattern is a triangle indicated by the shaded area 340. It is also seen that the right-most offset heater well 10, 245 of the pentagonal pattern 330 also acts as the left-most offset heater well 10, 245 of the pentagonal pattern to the right of the left-most pentagonal pattern. This is an example of sharing of heater wells between adjacent reservoir sections. In most cases, the bottom most heater well 10, 240 would be placed 5-8 m above the producer well, with variations depending upon the thermal conductivity, power output and desired pre-heating time. The triangular building block 325 ensures that the region near the producer well remains hot, thereby preventing a reduction in the mobility of the bitumen as it drains into the producer well.

As the thickness of the reservoir increases, it is advantageous to add more heater wells 10 using the pentagonal building block 330. Generally if the reservoir thickness is less than 50 m, the arrangement shown in FIG. 3 is employed, wherein the lower side of the upper pentagon pattern 330 is oriented to share a side with the upper side of the triangular pattern 325.

Figure 4:
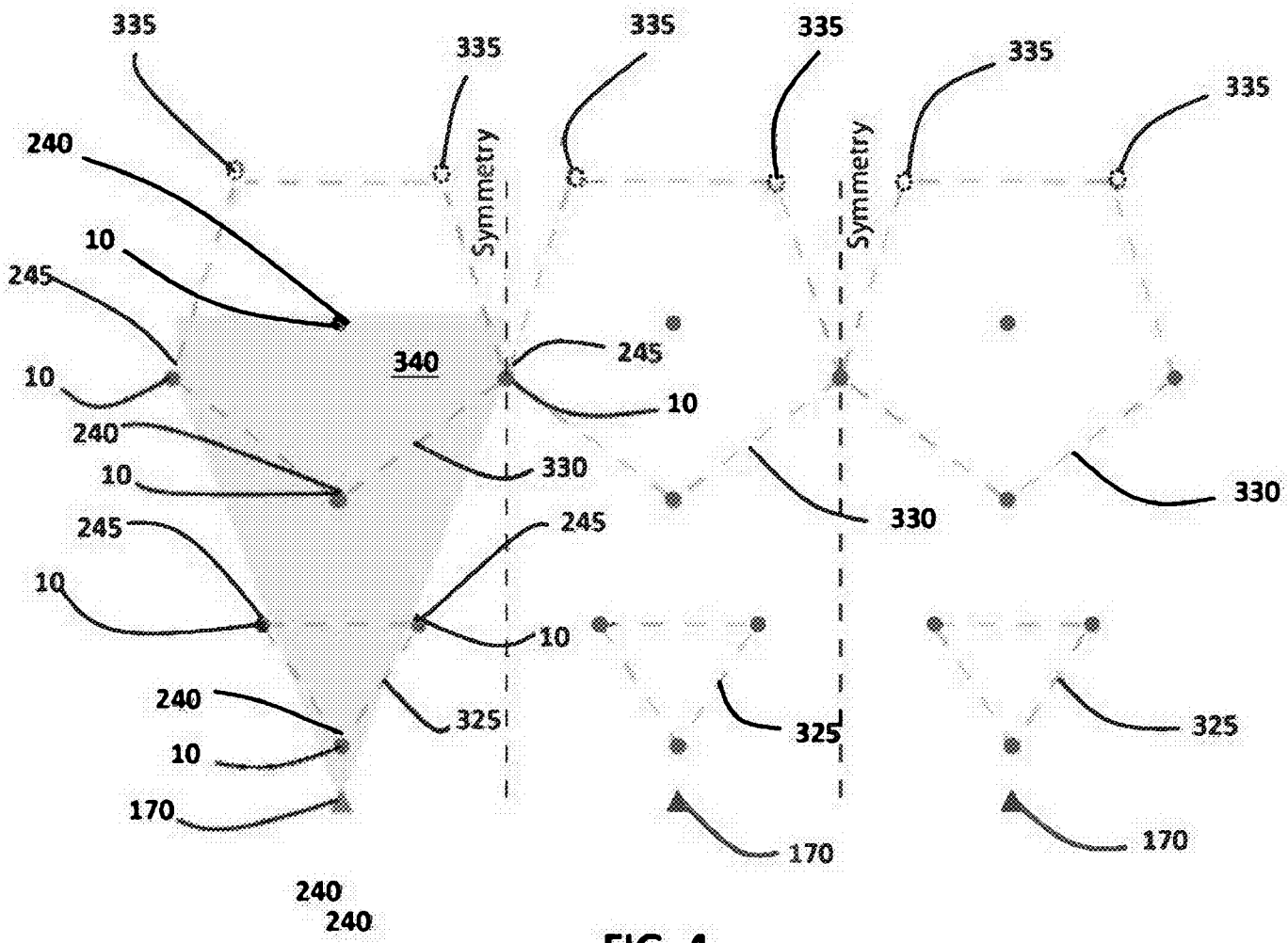
FIG. 4 is a cross section of three adjacent identical heater well patterns showing a second arrangement of a pattern with a triangular building block and a partial pentagonal building block with separation between the two building blocks.

Shown in FIG. 4 is another pattern which is used when the thickness of the reservoir exceeds 50 m. In this case, the pentagonal pattern 330 is elevated and rotated by 36° with respect to the orientation of the pentagonal pattern 330 of FIG. 3 such that the lowermost heater well 10 of this pattern is now an aligned heater well 240. The pentagonal pattern is a partial pentagon with two upper vacancies 335. The drainage volume shown by the shaded area 340 has changed in shape and increased in volume relative to that of FIG. 3.

Figure 5:
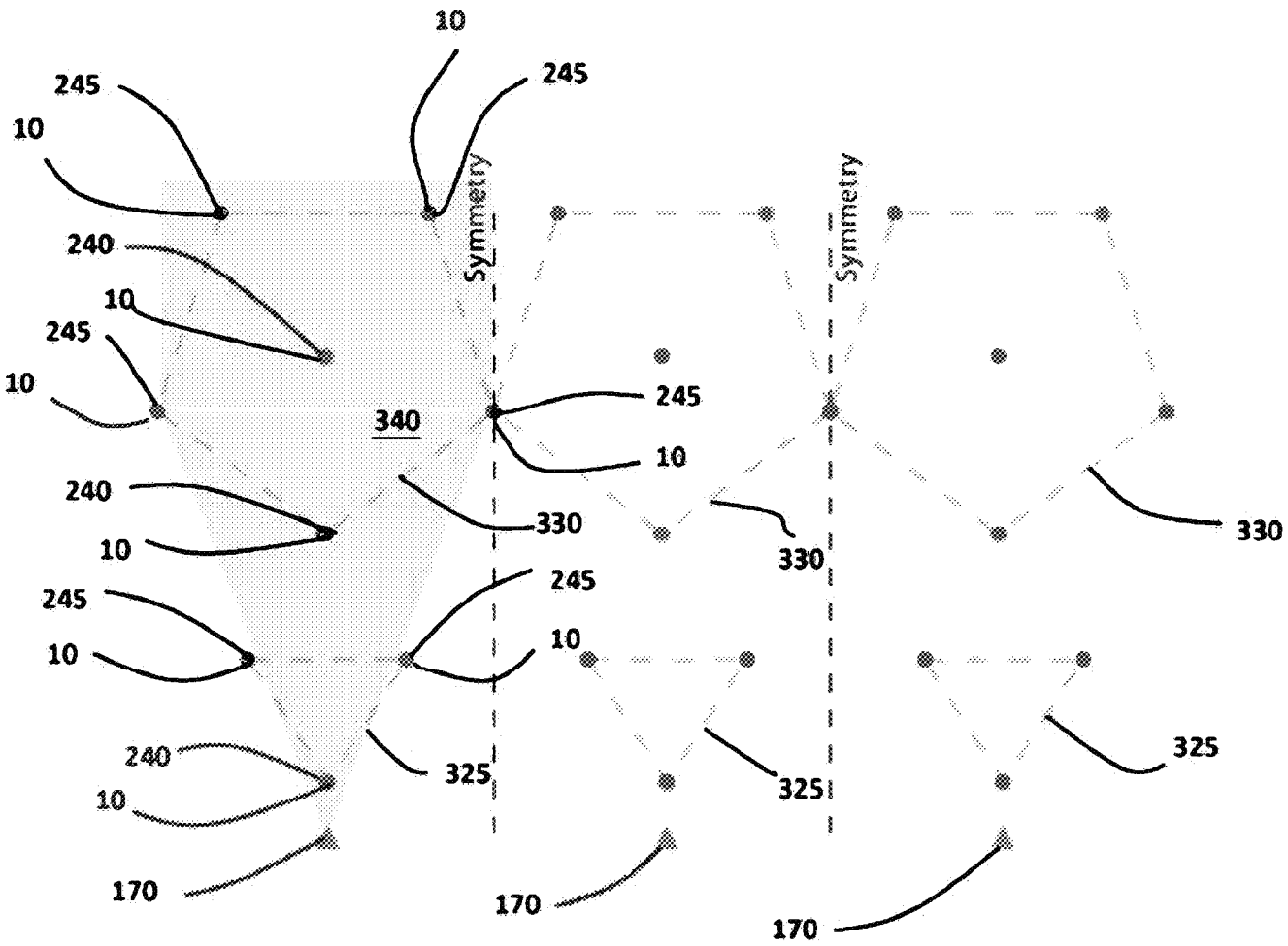
FIG. 5 is a cross section of three adjacent identical heater well patterns showing a third arrangement of a pattern with a triangular building block and a complete pentagonal building block with separation between the building blocks.

Shown in FIG. 5 is a pattern combination similar to that of FIG. 4, with the exception that offset heater wells 10, 245 occupy the upper corners of the pentagonal pattern 330 at positions which are vacant in FIG. 4. This has the effect of increasing the heat provided at upper levels of the pattern. As noted above, the initial drainage occurs primarily along a central column directly above the producer well 170. With time, the laterally positioned heater wells 10, 245, widen the thermal column (in each of FIGS. 3-5, the drainage volume is the shaded area 340.

Figure 6:
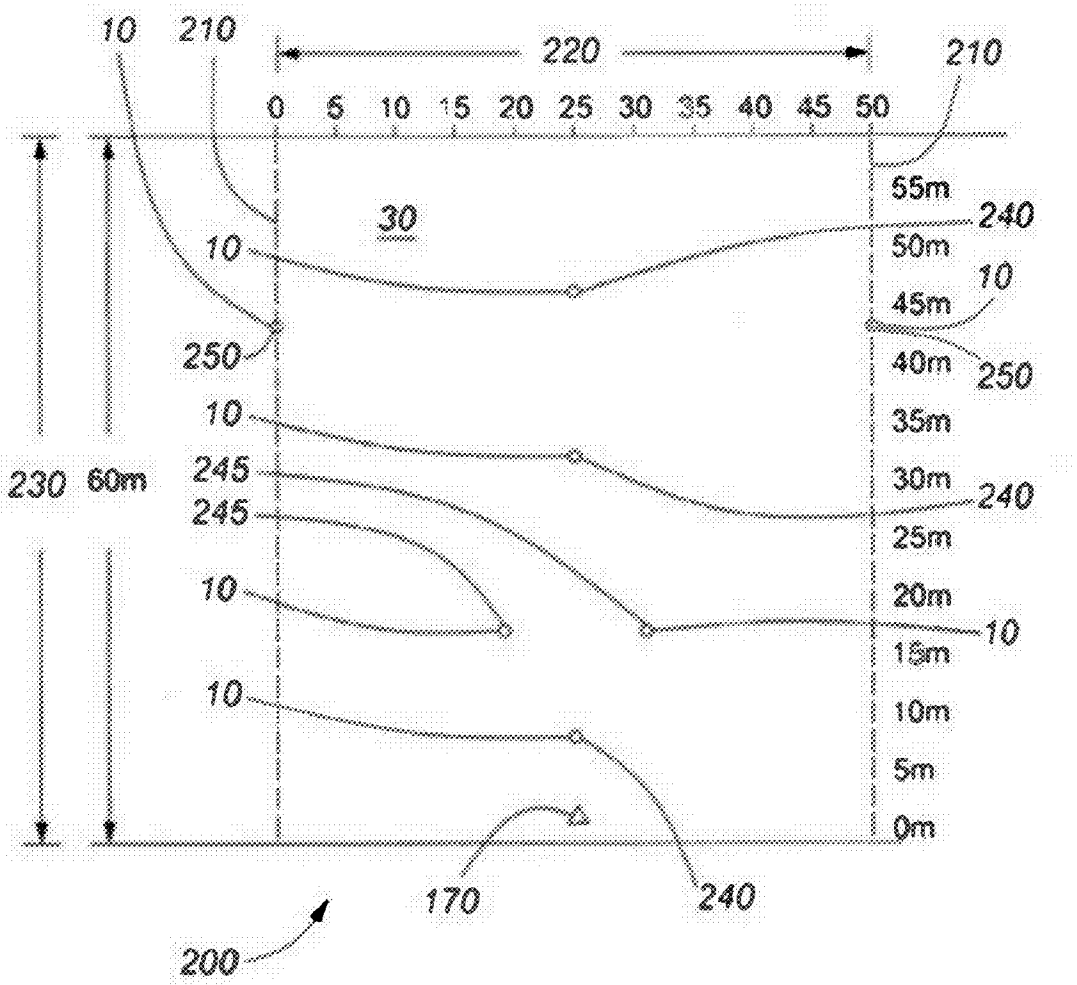
FIG. 6 is a cross-section of a first pattern with a 60 m thick pay zone.
Figure 7:
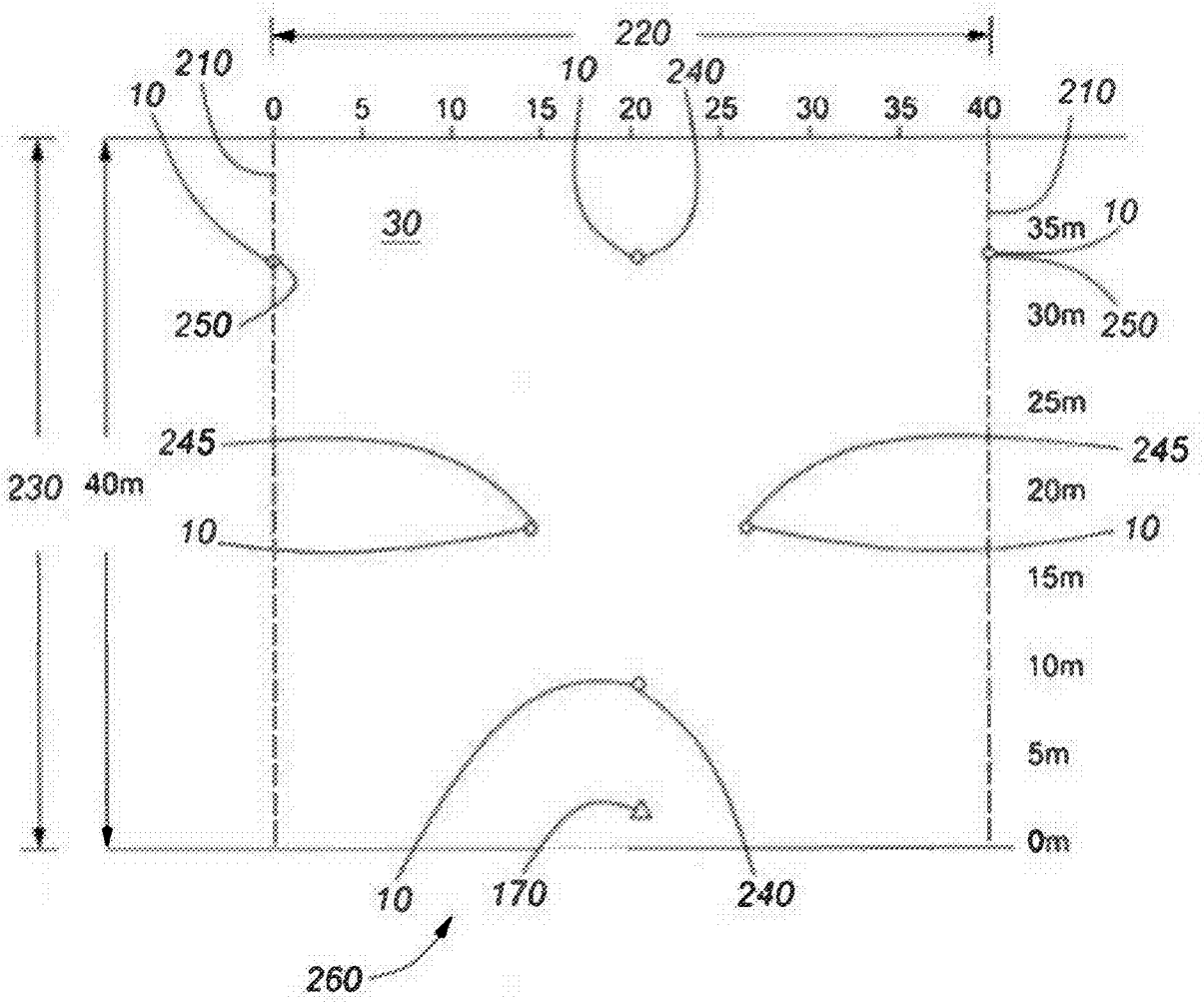
FIG. 7 is a cross-section of a second pattern with a 40 m thick pay zone.
Figure 8:
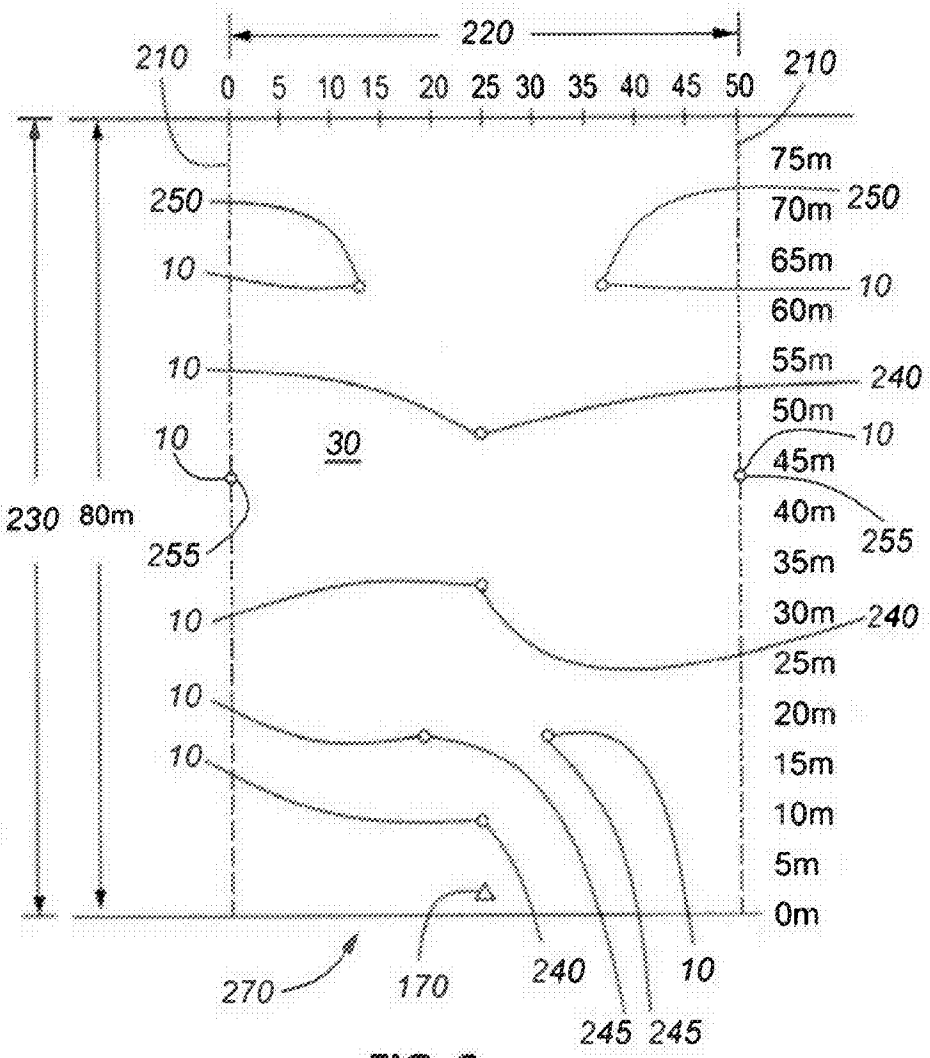
FIG. 8 is a cross-section of a third pattern with an 80 m thick pay zone.

FIGS. 6 to 8 are cross-sections of patterns with width and depth dimensions indicated. The pattern of FIG. 6 is similar to the pattern of FIG. 4. The pattern of FIG. 7 is similar to the pattern of FIG. 3. The pattern of FIG. 8 is similar to the pattern of FIG. 5. In each of FIGS. 6-8 the reservoir has a pay thickness 230 and a pattern width 220, and is defined by a no-flow boundary 210 at each end of the pattern width 220. The number of heater wells 10 and their respective locations relative to each other and to the heater producer well 170 may be varied to account for features of the reservoir 30 including pay thickness 230, vertical and horizontal permeabilities, well length, heater power output and temperature, and cost of wells and surface facilities.

FIG. 6 is a cross section of a first pattern 200. The pattern width 220 is 50 m and the pay zone 230 is 60 m thick. Six heater wells 10 and one heater producer well 170 are arranged in five rows in the first pattern 200. The heater wells 10 include aligned heater wells 240 above and substantially laterally aligned with the heater producer well 170. The heater wells 10 also include first offset heater wells 245 above and laterally offset from the heater producer well 170. The heater wells 10 also include second offset heater wells 250 above and laterally offset from the heater producer well 170 (with one half of a second offset heater well 250 at each no-flow boundary 210). The second offset heater wells 250 are laterally offset from the heater producer well 170 to a greater extent than the first offset heater wells 245.

The number of wells, the locations of the wells in the first pattern 200, and the heating output of the heaters were adjusted to obtain a high net present value. The simulation was based on the reservoir 30 and well properties indicated in Table 1.

TABLE 1

| Property | Quantity | Unit |
|---|---|---|
| Vertical Permeability | 2200 | mDarcy |
| Horizontal Permeability | 1100 | mDarcy |
| Porosity | 15 | % |
| Pay Thickness | 60 | m |
| Pressure at the Top of Reservoir (absolute) | 473 | kPa |
| Initial Reservoir Temperature | 11 | ° C. |
| Bitumen Saturation | 88 | % |
| Water Saturation | 12 | % |
| Irreducible Water Saturation | 10 | % |
| Dead Oil Viscosity at 11° C. | $14 \times 10^6$ | cP |
| Viscosity at 140° C. | 80 | cP |
| Reservoir Heater Power Output | 650 | W/m |
| Reservoir Producer Heater Power Output | 150 | W/m |
| Rock Heat Capacity at 11° C. | $2.41 \times 10^6$ | $J/m^3 \cdot °C.$ |
| Rock Heat Capacity at 140° C. | $2.88 \times 10^6$ | $J/m^3 \cdot °C.$ |
| Rock Thermal Conductivity at 11° C. | 4.6 | $W/(m \cdot K)$ |
| Rock Thermal Conductivity at 140° C. | 3.7 | $W/(m \cdot K)$ |
| Bottomhole Pressure (absolute) | 500 | kPa |

For a reservoir 30 with the pay zone 230 being thinner or thicker than the 60 m of FIG. 6, rows of wells may be respectively added or removed. Similarly, the lateral offset of first offset heater wells 245 or second offset heater wells 250 (or third offset heater wells 255 as seen in FIG. 8, or any offset heater wells generally) may be adjusted to account for a reservoir 30 with the thickness 220 being greater or less than the 50 m of FIG. 6.

FIG. 7 is a cross section of a second pattern 260. The pattern width 220 is 40 m and the pay zone 230 is 40 m thick. Five heater wells 10 and one heater producer well 170 are arranged in four rows. The heater wells 10 include aligned heater wells 240, first offset heater wells 245 and second offset heater wells 250 (with one half of a second offset heater well 250 at each no-flow boundary 210).

FIG. 8 is a cross section of a third pattern 270. The pattern width 220 is 50 m and the pay zone 230 is 80 m thick. Eight heater wells 10 and one heater producer well 170 are arranged in six rows. The heater wells 10 include aligned heater wells 240, first offset heater wells 245 and second offset heater wells 250. The heater wells further include third offset heater wells 255 (with one half of a third offset heater well 255 at each no-flow boundary 210). The third offset heater wells 255 are laterally offset from the heater producer well 170 to a greater extent than the second offset heater wells 250.

Figure 9:
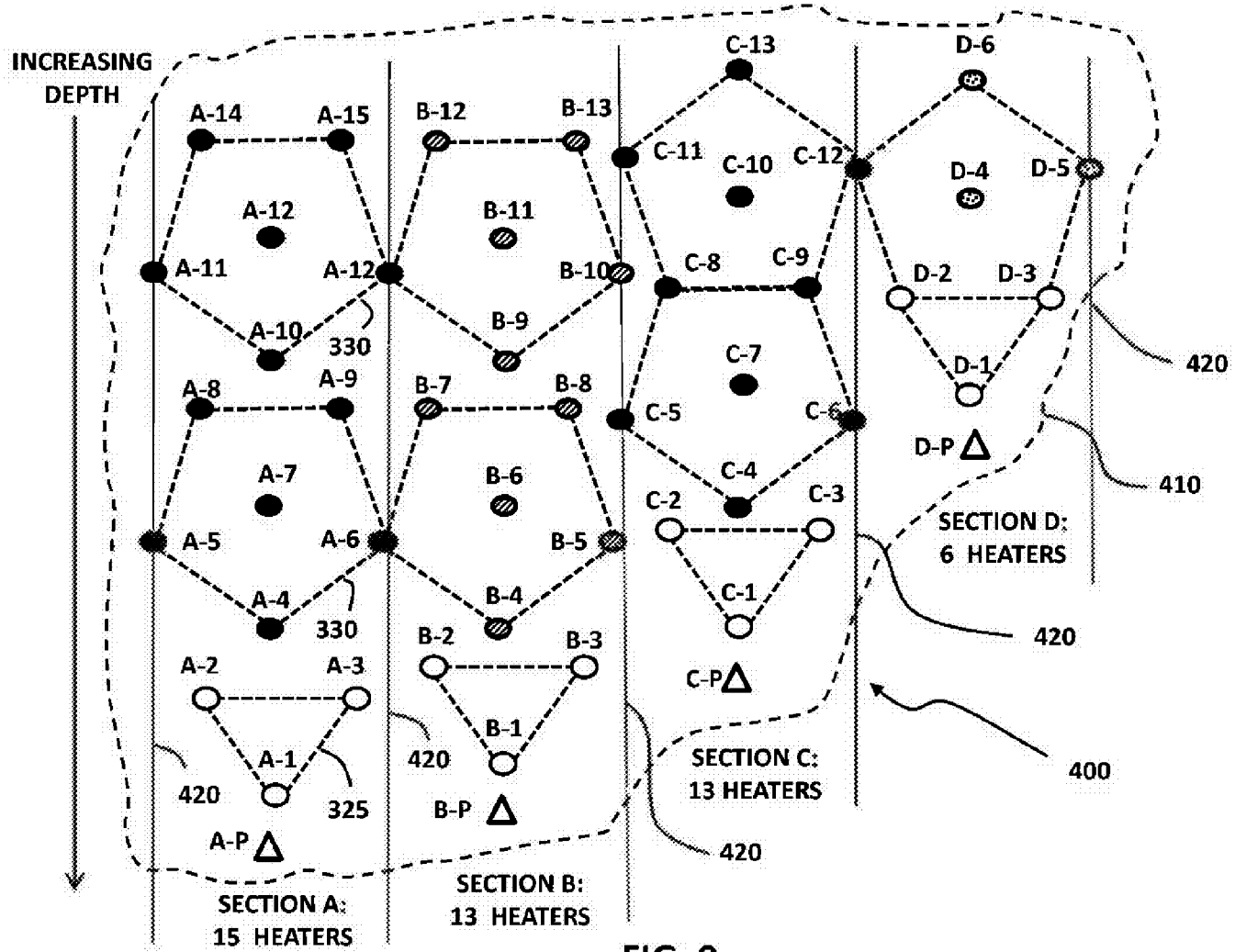
FIG. 9 is a cross-section of a reservoir divided into four lateral sections (Sections A to D) with a pattern of heater wells located in each section in an arrangement selected to optimize heating of available volume of each section.

FIG. 9 is a schematic cross-sectional view of a reservoir of irregular shape divided into four sections (A-D). This view shows how different heater well patterns may be assembled to provide optimal drainage volumes across a reservoir. The optimization provides maximal drainage of the bitumen or heavy oil from the reservoir with the minimal number of heater wells, thereby optimizing recovery efforts in terms of energy and cost.

In FIG. 9, a defined reservoir 400 with a boundary 410 is divided into four sections (Sections A-D) ranging in width between about 40 to about 60 m and a heater pattern is selected for each of the four sections with section boundaries 420. In this particular example, the first two leftmost sections (Sections A and B) have close to the same depth while the third Section (Section C) has less thickness and the fourth section (Section D) is considerably less thick. It is seen that Sections A and B have the same building block pattern and that the patterns of Section C and Section D are distinct from each other and from the patterns of Section A and B.

In placement of heater wells above the producer well, a triangular pattern of heater wells 325 is first placed above the producer well as indicated in FIG. 9 in an orientation with the lower vertex oriented above the producer well and the two higher vertices located at the same level above the lower vertex. Then, one or more pentagonal patterns of heater wells 330 is/are placed above the triangular pattern, depending upon the depth of the remaining portion of the lateral section. In some cases the orientation of the pentagonal pattern(s) 330 is/are altered. While not shown in FIG. 9, it is understood from FIGS. 3, 4, 6 and 7 that uppermost heater wells of a pentagonal pattern 330 may be omitted if they would extend above the desired drainage volume.

For the purposes of this illustration, the heater wells and producer wells are identified according to the section in which they are located (the heater wells of section A are heater wells A-1 to A-15; the heater wells of section B are heater wells B-1 to B-13; the heater wells of section C are heater wells C-1 to C-13; and the heater wells of section D are heater wells D-1 to D-6). The same convention holds for the producer wells which are designated A-P, B-P, C-P and D-P.

Sections A and B—In Sections A and B (FIG. 9), the arrangement of triangular 325 and pentagonal 330 patterns above their respective producer wells A-P and B-P is identical because the depths of reservoir Sections A and B are similar. However, it is seen that two of the heater wells of the pentagonal pattern of section A (heater wells A-6 and A-12) are shared with the adjacent pentagonal pattern of heater wells of section B. This sharing of heater wells provides the advantage of requiring fewer heater wells in section B (15 heater wells in section A vs. 13 heater wells in section B). This is advantageous because heaters are costly to produce and operate and because it minimizes the number of heater wells to be drilled.

Section C—Section C has a different pattern than the pattern of Sections A and B. This pattern is also different from other patterns described hereinabove. Notably, the uppermost pentagonal pattern is oriented such that its lowermost edge is shared with the uppermost edge of the lowermost pentagonal pattern with the two heater wells of the shared edge (C-8 and C-9) shared between the two pentagons. Section C therefore requires 13 heater wells (C-1 to C-13).

Section D—If the depth of the remaining portion of the lateral section of the reservoir is less than 50 m, a pentagonal pattern is arranged as shown for Section D with offset lower vertices of the pentagon superimposed on the upper offset vertices of the triangular pattern. This is similar to the pattern illustrated in FIGS. 3 and 6, with the exception that the vacancy 335 shown in FIG. 3 is occupied by heater well D-6 in the pattern of Section D. Heater wells are not required at the two lower vertices of the pentagon for the pattern of Section D because the pentagon shares the edge with the edge formed by the heater wells originating from the triangular pattern D-2 and D-3. The pattern of Section D also dispenses with an additional heater well at the left boundary of the lateral section because heater well C-12 has already been placed at that location for pattern C. As a result, the pattern of Section D requires only 6 heater wells.

If a given lateral section has reduced thickness relative to a neighboring section, the pentagonal pattern may be modified by removing some of the upper heaters.

Conductive Heating

Conductive heating provides for more uniform temperature distribution in the reservoir 30 relative to convective heating processes such as those dependent on steam injection. The greater uniformity provides greater predictability of the temperature distribution. As a result, a TAGD pattern may be more easily optimized for a particular set of reservoir conditions than a pattern for a recovery process based on convective heating, for example steam assisted gravity drainage (SAGD) or cyclic steam stimulation (CSS). The number of wells and spacing between wells may be adjusted to account for differences between individual reservoirs with respect to the thicknesses, permeabilities, pressures, temperatures, and other properties of the reservoirs, but the presence of obstacles does not introduce as much uncertainty as in processes based on convective heating.

In reservoirs having impermeable or semi-impermeable barriers, such as shale extending across portions of the reservoir, the vertical growth of a SAGD or CSS steam chamber may be impeded by the barriers. However, thermal energy transfer by conductive heating as in the present disclosure may pass through or around the barriers, mitigating the impact of the barriers on production, recovery, or both.

Production

Production may be described as occurring in three general stages: a ramp-up stage, a peak production stage, and a production decline stage. FIGS. 10 to 21 are plots of simulation data for the first pattern 200 of FIG. 3 at each of the stages wherein the heating zones 70 and the producer heating zones 100 each extend along a substantially horizontal well length of 1600 m. In an embodiment, the bitumen or heavy oil produced from the reservoir 30 is produced substantially as a liquid via the pump 150. In an embodiment, there is no appreciable vaporization of bitumen or heavy oil in the reservoir 30 or the near heater zone 180, or both.

Ramp-Up Stage

Figure 10:
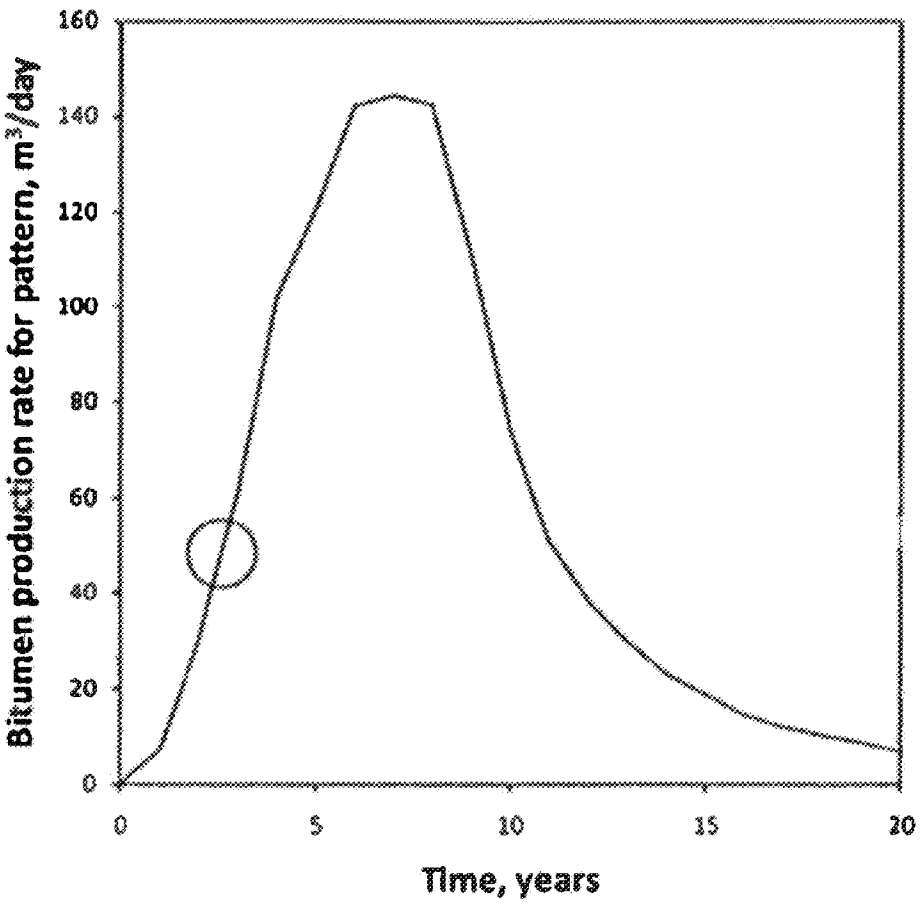
FIG. 10 is a plot of the bitumen production rate from a simulation of the pattern of FIG. 6 versus time with a portion of a ramp-up stage indicated at about 3 years.
Figures 11, 12:
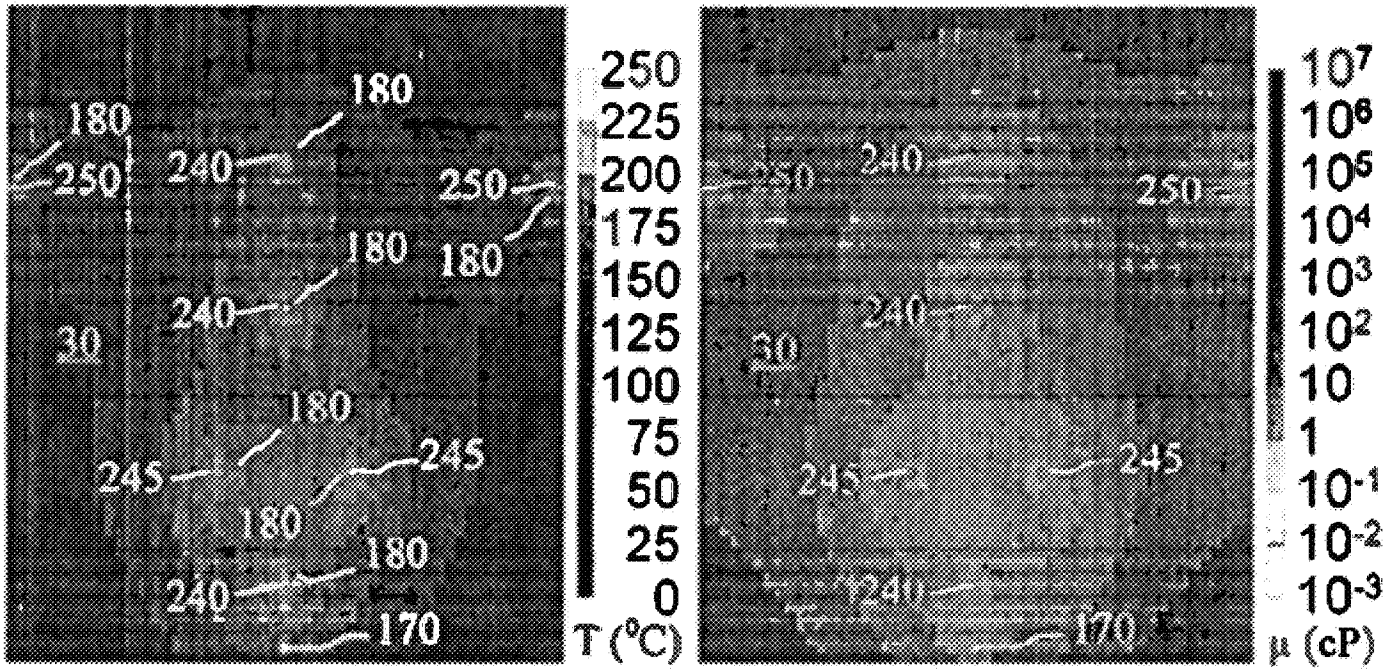
FIG. 11 is a plot of temperature in the pattern of FIG. 6 at 3 years.
FIG. 12 is a plot of viscosity in the pattern of FIG. 6 at 3 years.
Figure 13:
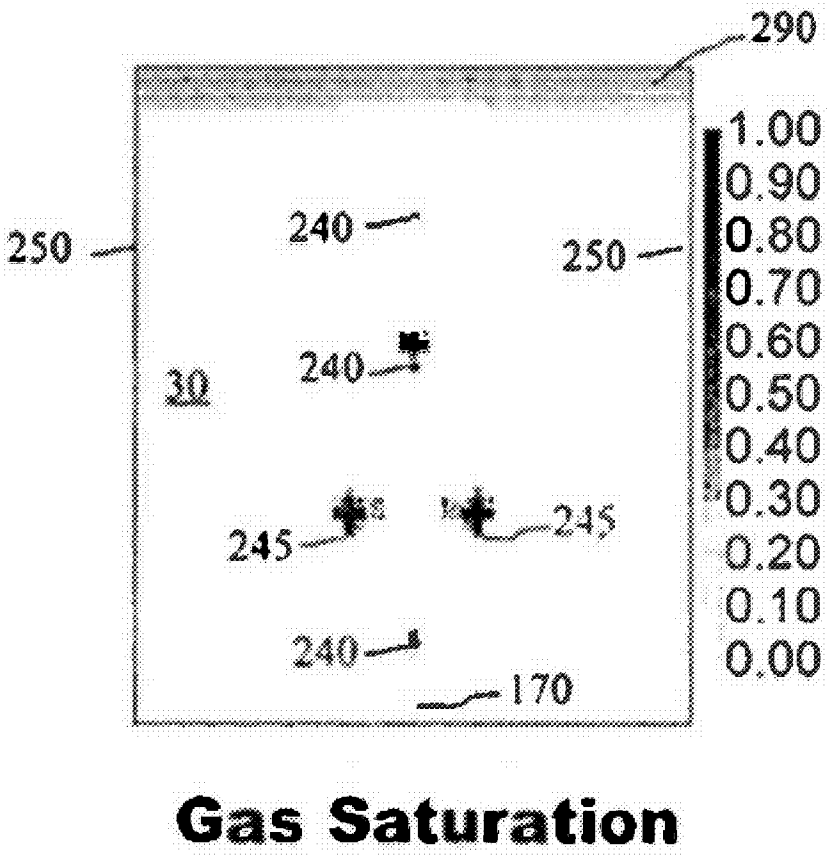
FIG. 13 is a plot of gas saturation in the pattern of FIG. 6 at 3 years.

FIG. 10 is a plot of the bitumen production rate versus time for the simulation with a portion of the ramp-up stage indicated at about 3 years. FIGS. 11 to 13 are respectively plots of temperature, viscosity, and gas saturation distributions in the reservoir 30 with the first pattern 200 at 3 years into the simulation.

Figures 15, 16:
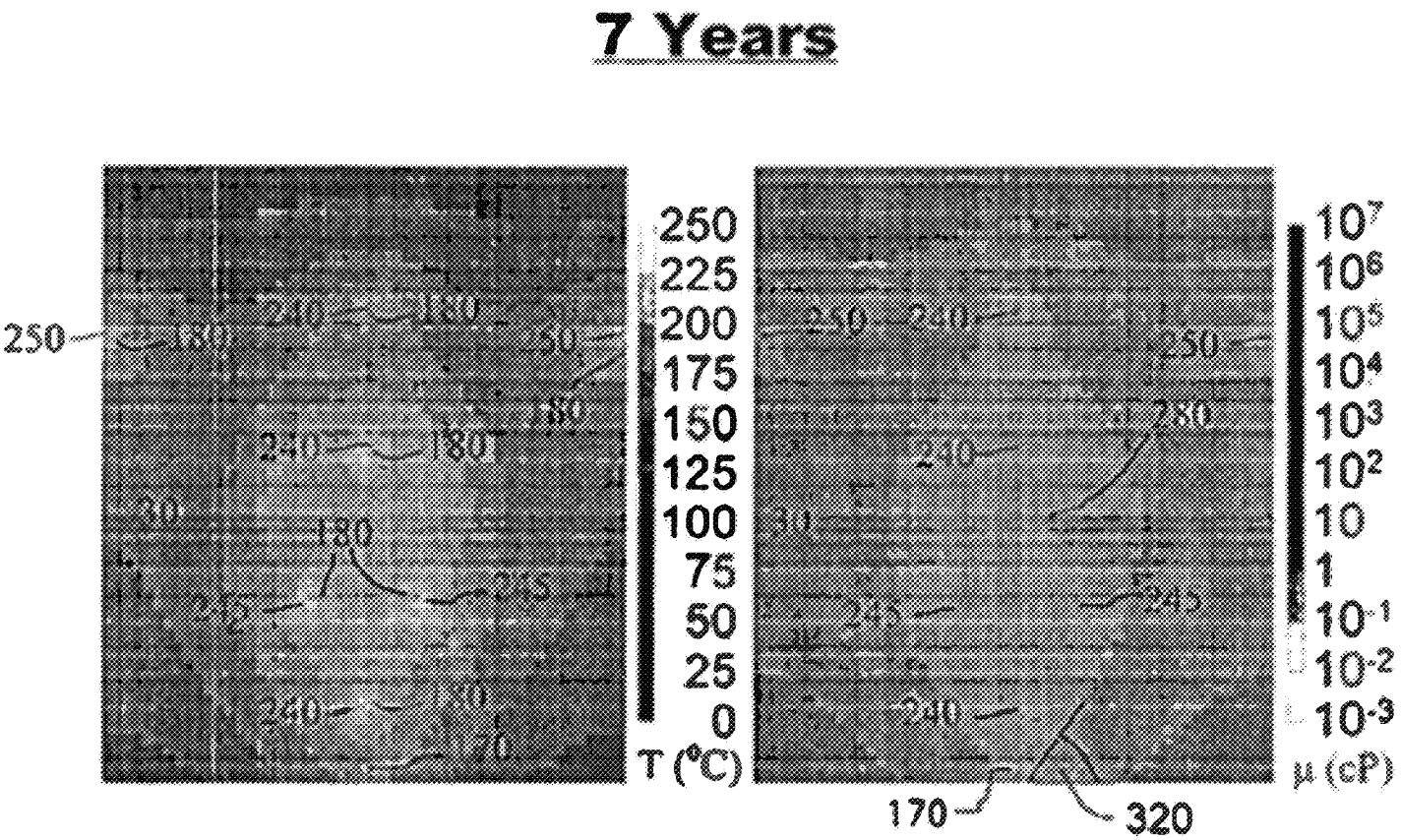
FIG. 15 is a plot of temperature in the pattern of FIG. 6 at 7 years.
FIG. 16 is a plot of viscosity in the pattern of FIG. 6 at 7 years.

The temperature distribution ranges from about 12° C. in the majority of the reservoir 30 to about 250° C. at the near heater zones 180. During the ramp-up stage (from start-up to about two years of heating), significant increases in temperature that result in a portion of the reservoir 30 reaching the target average temperature of between about 120° C. and about 160° C. primarily occur in the vicinity of the near heater zones 180. The viscosity in the reservoir 30 ranges from 1000 cP or greater in the majority of the reservoir 30 to about 10 cP in the near heater zones 180. Initial bitumen production is from a relatively small volume of heated bitumen in the vicinity of the heater producer well 170. The gas saturation ranges from 0 in the majority of the reservoir 30 to about 0.4 at the lowermost aligned heater well 240 and in a gassy-bitumen zone 290. A mobilized column 280 of connected mobile bitumen that connects the aligned heater wells 240, the first offset heater wells 245, and the producer well 20 has yet to form (FIG. 16).

As time passes and the reservoir 30 is heated further, the average temperature of the reservoir 30 increases, the viscosity of bitumen in the reservoir 30 decreases, and a gas chamber 300 (FIG. 17) forms and expands generally upwards.

Peak Production Stage

Figure 14:
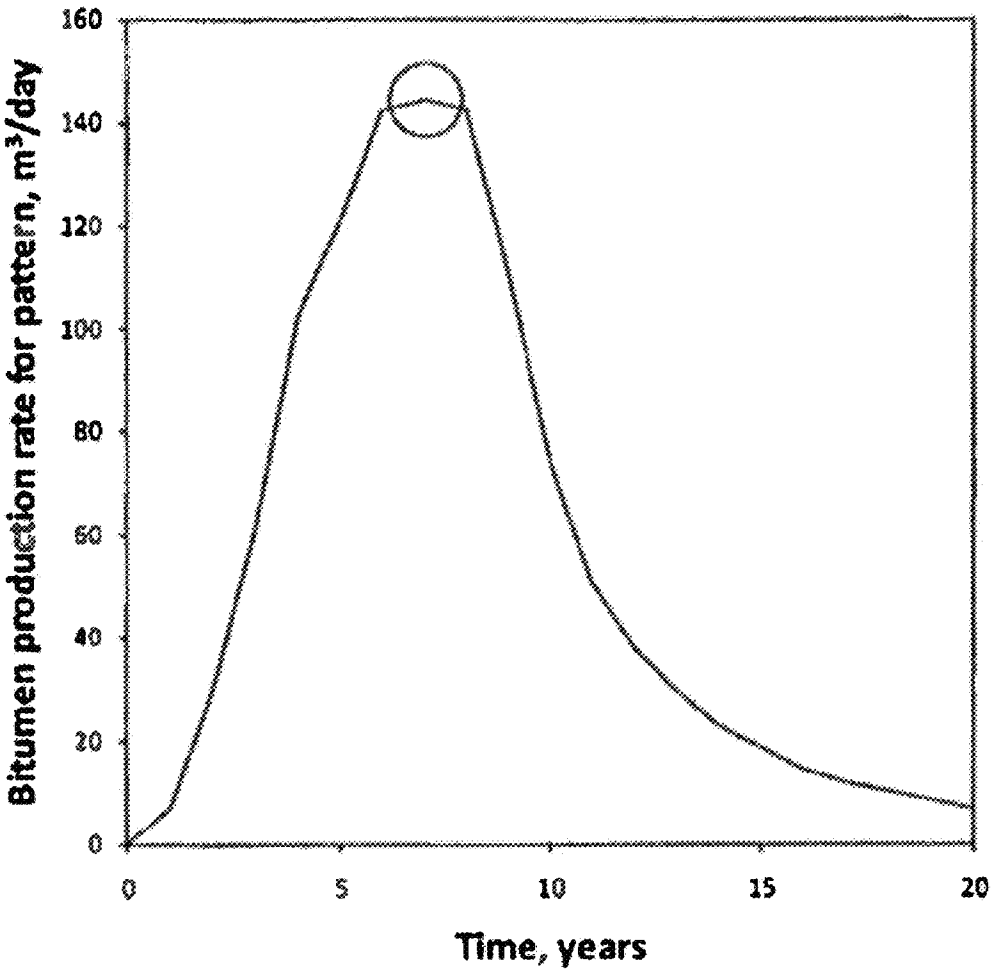
FIG. 14 is a plot of the bitumen production rate versus time with a portion of a peak production stage indicated at about 7 years.
Figure 17:
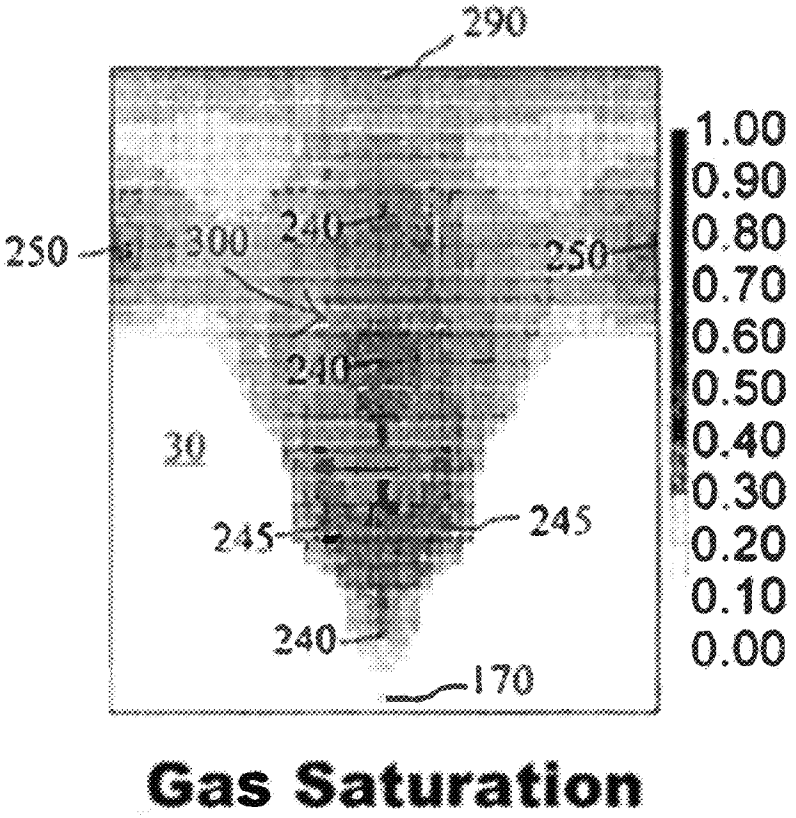
FIG. 17 is a plot of gas saturation in the pattern of FIG. 6 at 7 years.

FIG. 14 is a plot of the bitumen production rate for the first pattern 200 with a portion of the peak production stage indicated at about 7 years. FIGS. 15 to 17 are plots of temperature, viscosity, and gas saturation distributions in the reservoir 30 at a point 7 years into the simulation.

The average temperature in the reservoir 30 has increased relative to the ramp-up stage. A significant volume of bitumen is at the target average temperature of between about 120° C. and about 160° C. As a result, a mobilized column 280 of bitumen has formed in the reservoir 30 above the heater producer well 170 wherein the viscosity of the bitumen is below 1000 cP and is about 100 cP in much of the mobilized column 280. The aligned heater wells 240, the first offset heater wells 245, and the heater producer well 170 are within the mobilized column 280. A gas chamber 300 comprising evolved solution gas and water vapor has also formed and moves upward as bitumen drains down to the heater producer well 170. The gas chamber 300 provides internal drive and voidage replacement (see below).

Continued heating increases the height and width of the mobilized column 280 with a concurrent increase in bitumen production rate. Peak production occurs due to a favorable combination of pressures and viscosity when the mobilized column 280 has reached a maximum height. The gas chamber 300 has reached a significant size and the aligned heater wells 240 and the first offset heater wells 245 are within the gas chamber 300. During the peak production stage, thermal energy output from the heater wells 10 or the heater producer well 170, or both, may be reduced to maintain the target average temperature of between about 120° C. and about 160° C. in the reservoir 30 without additional increase in temperature to maximize efficiency of energy use.

Production Decline Stage

Figure 18:
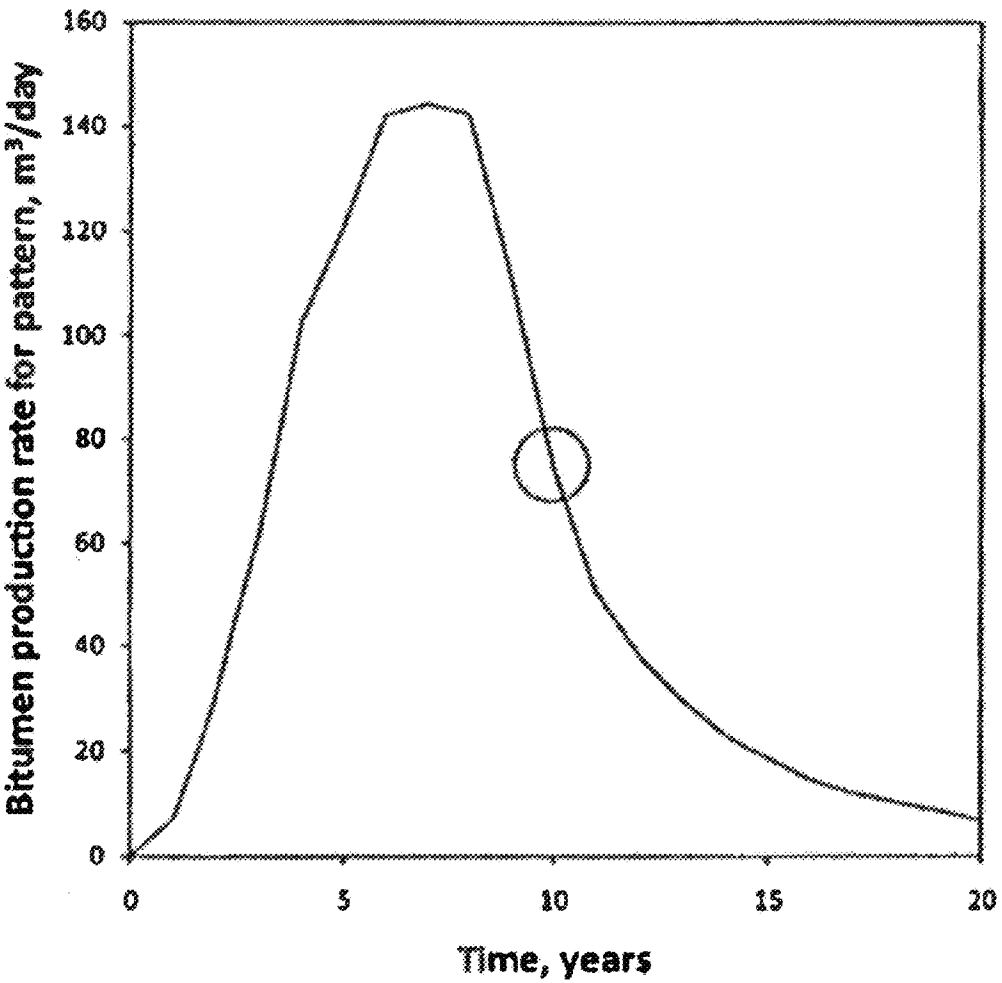
FIG. 18 is a plot of the bitumen production rate versus time with a portion of a production decline stage indicated at about 10 years.
Figures 19, 20:
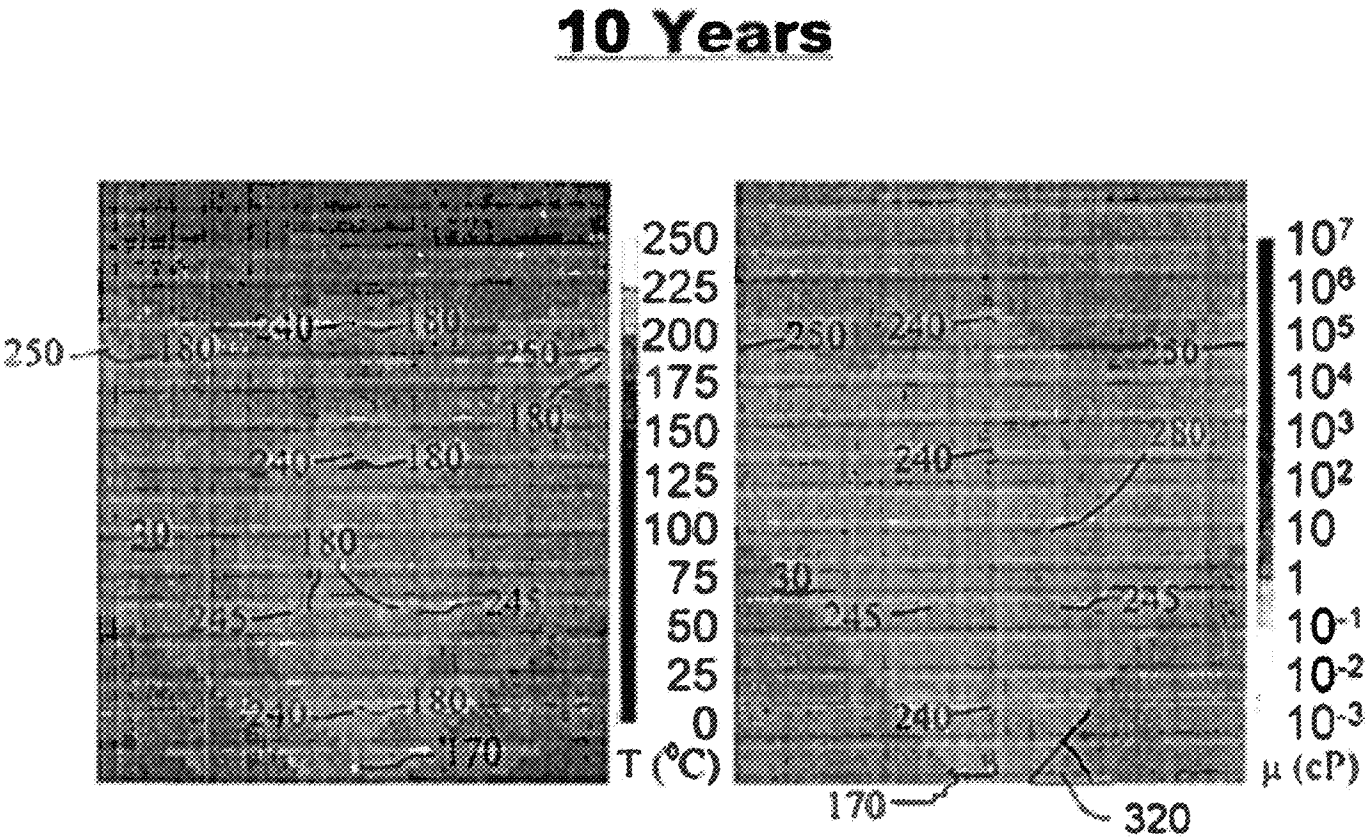
FIG. 19 is a plot of temperature in the pattern of FIG. 6 at 10 years.
FIG. 20 is a plot of viscosity in the pattern of FIG. 6 at 10 years.
Figure 21:
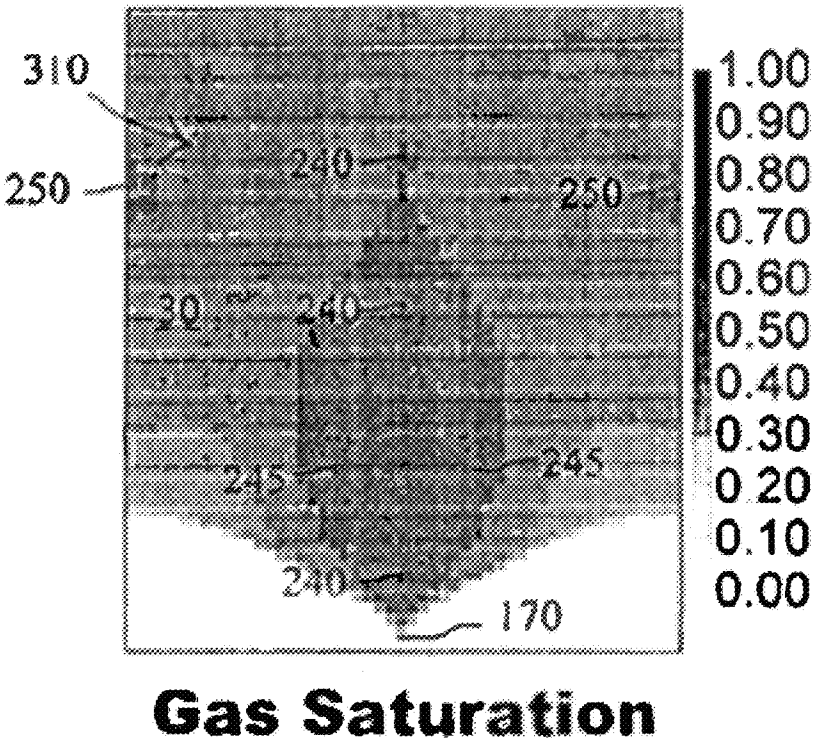
FIG. 21 is a plot of gas saturation in the pattern of FIG. 6 of at 10 years.

FIG. 18 is a plot of the bitumen production rate for the first pattern 200 with a portion of the production decline stage indicated at about 10 years. FIGS. 19 to 21 are plots of temperature, viscosity, and gas saturation distributions at 10 years into the simulation.

During the production decline stage, the majority of the reservoir 30 is at the target average temperature of between about 120° C. and about 160° C. and the majority of the bitumen has a sufficiently low viscosity to be substantially mobile. The gas chamber 300 has merged with the gassy-bitumen zone 290 to form a secondary gas cap 310. The secondary gas cap 310 includes evolved solution gas and water vapor. An angle 320 at which mobilized bitumen drains to the heater producer well 170 becomes increasingly acute to the horizontal. During the production decline stage, the reservoir heaters 80 may be turned down to deliver less thermal energy than during previous stages (FIG. 23), and may even be turned off (not shown). As a result, while the near heater zones 180 remain, the difference in temperature between the near heater zones 180 and the majority of the reservoir 30 is less pronounced. At abandonment, the remaining oil-in-place is contained at near residual saturations within the gas chamber 300, and near the base of the reservoir 30 at an angle 320 that is unfavourably acute to the horizontal with respect to the heater producer well 170.

Summary of Value Indicators Over Time

Figure 22:
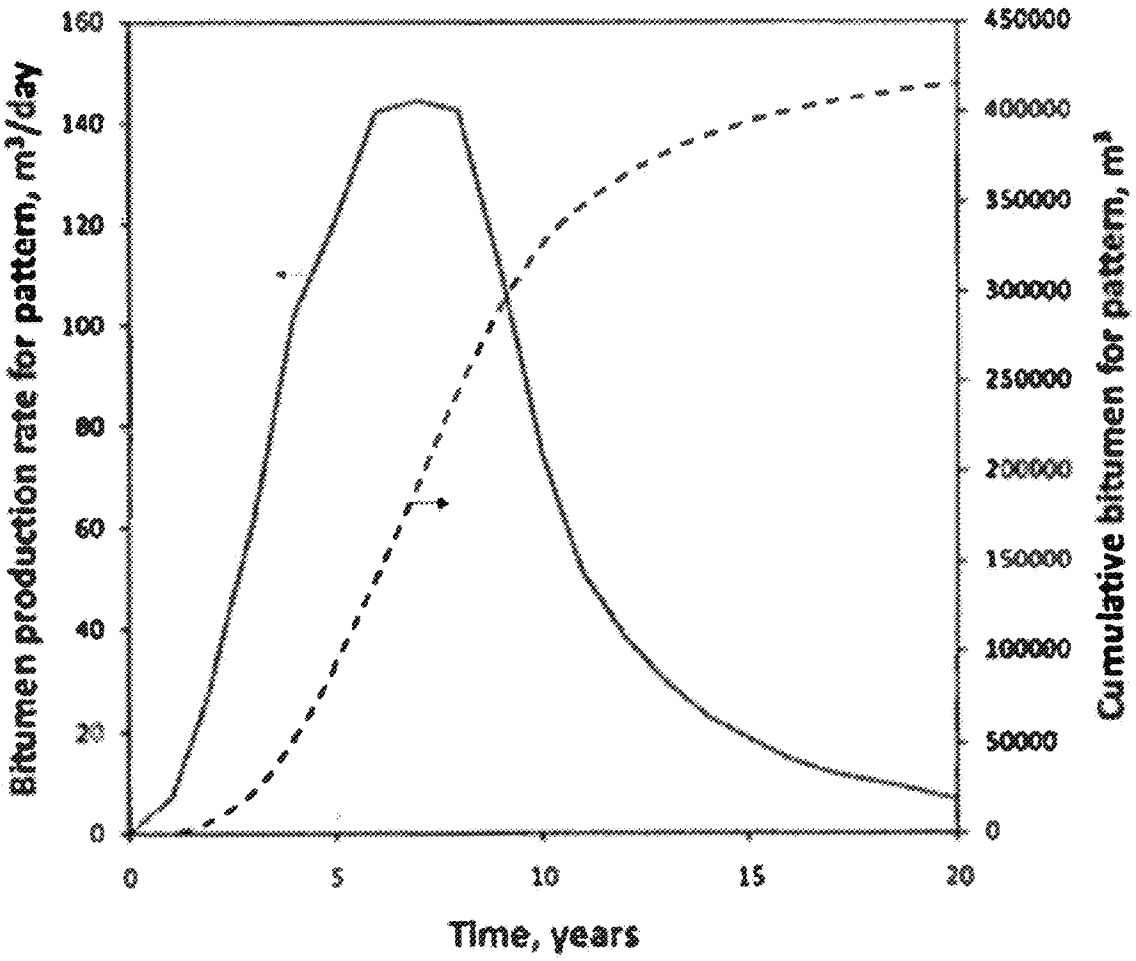
FIG. 22 is a plot of bitumen production rate and cumulative bitumen production versus time for the pattern of FIG. 6.

FIG. 22 is a plot of the bitumen production rate and the cumulative recovered bitumen of the simulation versus time. The peak production rate of 145 $m^3$/day and overall recovery after 20 years is about 69% of OOIP. The peak production rate and overall recovery are comparable to that observed for an average SAGD well pair.

Figure 23:
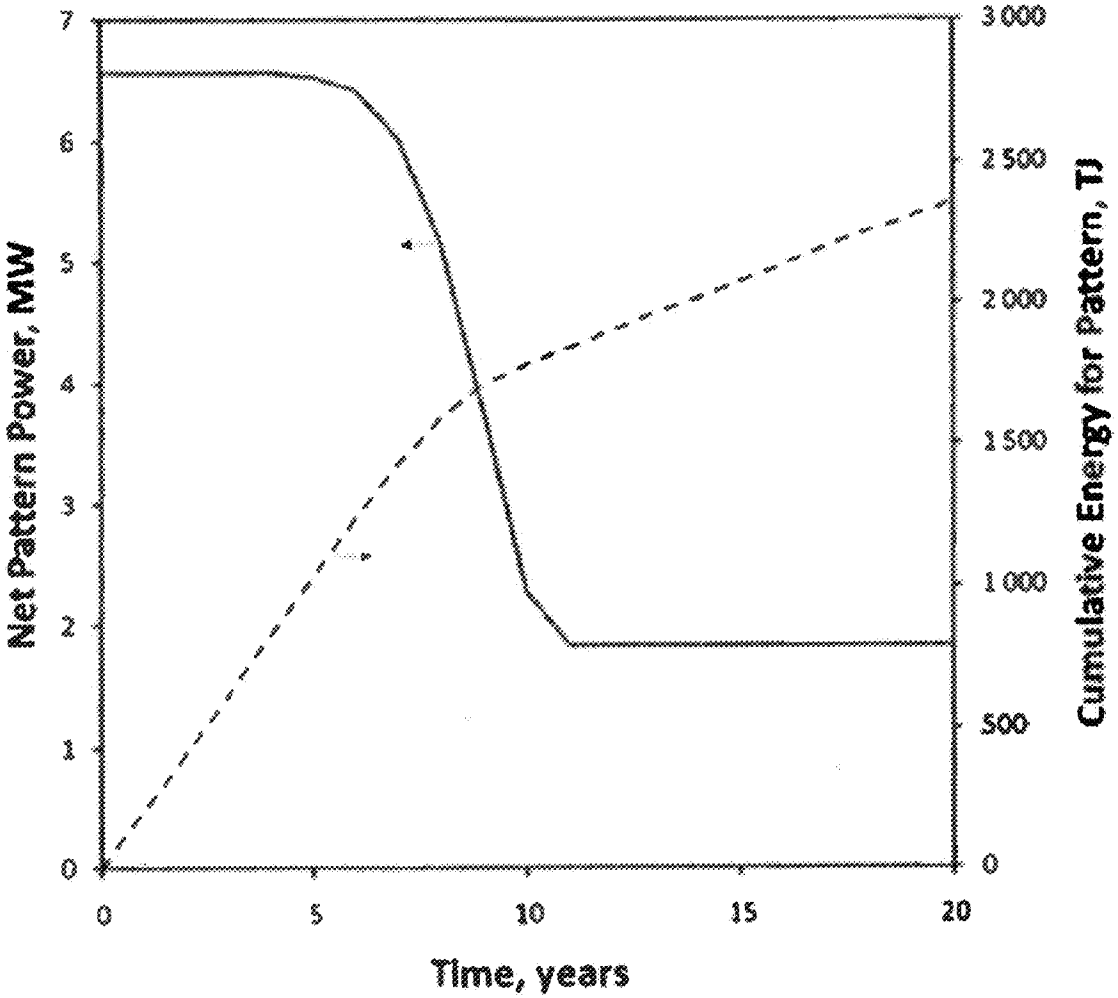
FIG. 23 is a plot of net pattern power and cumulative energy requirements versus time for the pattern of FIG. 6.

FIG. 23 is a plot of the net pattern power and the cumulative energy of the simulation versus time with 650 W/m of power output to the six heater wells 10 and 150 W/m of power output to the heater producer well 170. Each of the heater wells 10 has a 1600 m long heating zone 70 and the heater producer well 170 has a 1600 m long producer heating zone 100. The net pattern power drops and levels off when thermal energy output from the heater wells 10 and the heater producer well 170 is reduced from the above levels. Reduction in thermal energy output allows the target average temperature of between about 120° C. and about 160° C. to be maintained (but not further increased) while using less power.

Figure 24:
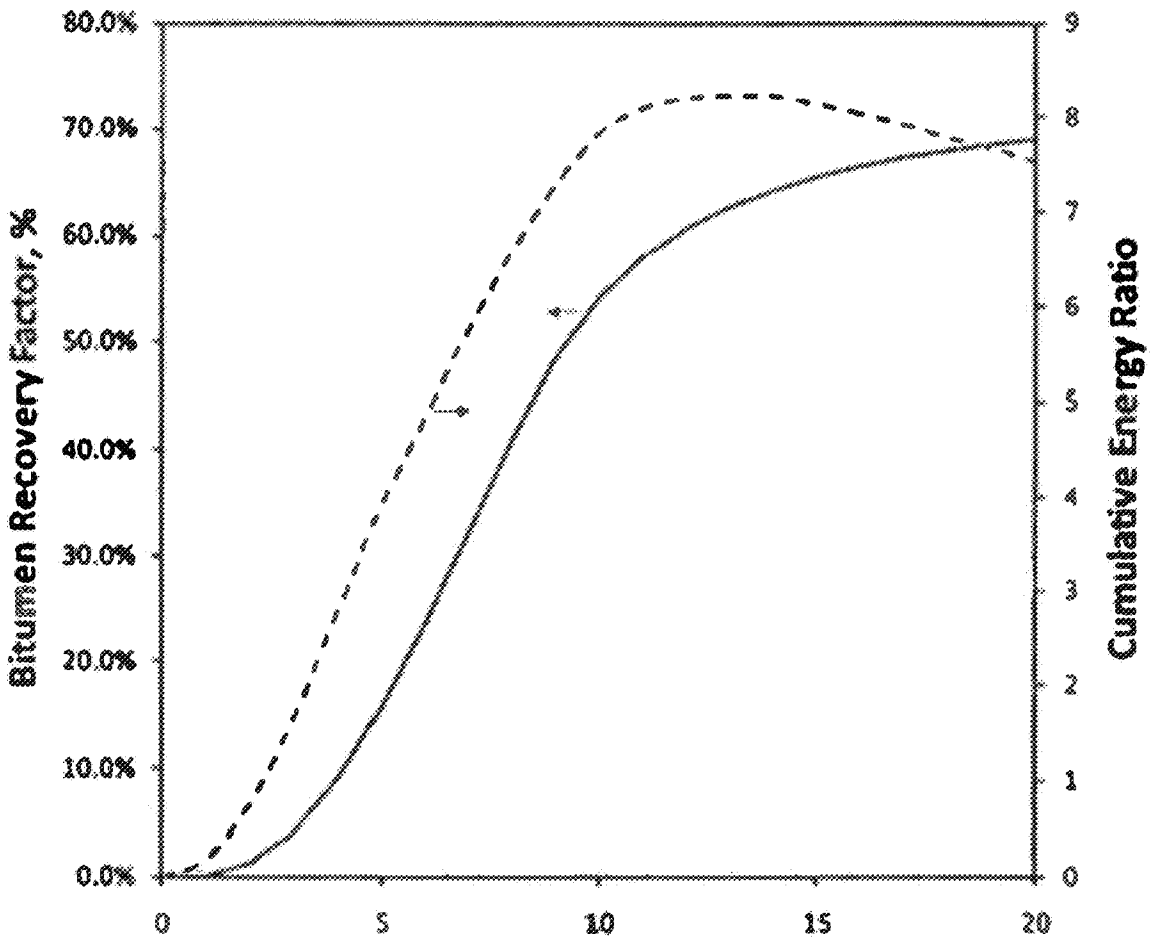
FIG. 24 is a plot of the bitumen recovery factor and cumulative energy ratio versus time for the pattern of FIG. 6.

FIG. 24 is a plot of the bitumen recovery factor and the cumulative energy ratio of the simulation versus time.

Voidage Replacement

To effectively drain hot mobilized bitumen or heavy oil, produced volumes must be replaced to prevent establishment of low reservoir pressures. Low reservoir pressures may prevent economical production. Without wishing to be bound by any theory, the simulation indicates that voidage replacement may occur by one or more of at least three mechanisms.

First, evolution of solution gas from the bitumen or heavy oil. Solubility of gas in bitumen or heavy oil decreases significantly with increasing temperature. As the bitumen or heavy oil is heated, solution gas evolves from the bitumen or heavy oil. The specific volume of the dissolved gas component is significantly greater in the gas phase than in the solution phase, thus replacing some of the voidage created by production. For example, at 140° C. and 500 kPa (absolute), the specific volume of the solution gas component is about 200 times greater in the gas phase than as a dissolved component in the liquid bitumen or heavy oil phase.

Second, vaporization of connate water in low-pressure reservoirs (for example shallow reservoirs). The specific volume of steam is significantly greater than that of liquid water. At 140° C., the specific volume of saturated steam is about 500 times greater than that of saturated liquid water. A portion of the reservoir 30 will exceed the saturation temperature thus leading to the vaporization of some of the connate water initially in place and thus contributing to voidage replacement. The target average temperature of the reservoir 30 is between about 120° C. and about 160° C. so water may boil where the average temperature of the reservoir 30 is on the upper end of this range and water will boil in the near heater zones 180.

Third, expansion of in-place volumes. Although less significant that the solution gas evolution and vaporization of connate water processes noted above, some voidage replacement will be realized by thermal expansion of in-place hydrocarbons, connate water and free gas. For example, an expansion of about 10% is estimated at 140° C. and 500 kPa (absolute).

Gas Injection

Gas injection into a gassy-bitumen zone 290, a gas cap (not shown), or a gas-bitumen transition zone (not shown) overlying the reservoir 30 at or near the beginning of the ramp-up stage may allow the ramp-up stage to be completed in a shorter time frame. In the simulation, the peak production stage began about two years sooner with gas injection (i.e. at about 5 years instead of about 7 years). Gas injection provides further drive to the gravity drainage process. Gas injection may be stopped once the injected gas begins to break-through to the producer well 20. A variety of non-condensable gases may be used, including natural gas, nitrogen, carbon dioxide, or flue gas.

Advantages of TAGD

The TAGD recovery process has several important advantages over other thermal processes used to recover bitumen or heavy oil (e.g. SAGD, CSS, and hybrid steam injection with solvent).

TAGD allows more uniform and predictable heating of a reservoir relative to steam injection processes. In steam injection processes, transfer of thermal energy is accomplished through convection in which thermal energy is carried throughout the reservoir by fluid flow. Transfer of thermal energy by convection is governed by pressure differential and the effective permeability of the reservoir. The effective permeability may vary by orders of magnitude within a carbonate reservoir. Low permeability layers may block or retard the flow of steam. Steam may also flow preferentially in natural fractures thus bypassing the majority of the reservoir and resulting in poor steam conformance. Poor steam conformance results in poor recovery and high steam-oil ratios, and therefore in unfavourable economics.

Heat conduction is governed largely by a temperature difference and the effective thermal conductivity of a reservoir. The effective thermal conductivity of the reservoir is a function of rock mineralogy, reservoir porosity, and the saturations and thermal conductivities of the fluids in the reservoir, including bitumen or heavy oil, water and gas. In general, unlike reservoir permeability, the variation of thermal conductivity throughout the reservoir is relatively minor and is expected to be less than about plus or minus 25%. The result will be a much more uniform temperature distribution within the reservoir.

TAGD allows more efficient use of input energy. In the SAGD recovery process, the temperature of a reservoir contacted by steam is determined by the reservoir pressure and is generally in excess of 200° C., such as about 260° C. Even higher temperatures are reached during the higher pressure CSS processes, such as about 330° C. By contrast, the target average temperature in TAGD is about 120° C. to about 160° C., thus requiring significantly less input energy, for comparable oil recovery (e.g. production rate or recovery factor, or both), than the processes based on steam injection.

TAGD does not require steam injection and therefore does not require water for steam generation. This may be an important advantage in field locations where a source of available water is absent or is costly to develop. The simulation indicates that produced water-oil ratios may be less than 0.5 $m^3/m^3$ after year 3 of production. In contrast, steam-based processes produce at water-oil ratios on the order of 3.0 $m^3/m^3$ (or 3:1). The initial water-oil ratio in TAGD is a function of the mobility of water present in the reservoir prior to heating, and may vary from reservoir to reservoir. In addition to lowered water use, this advantage also provides the benefit of allowing processing facilities for produced bitumen to be smaller, simpler in design, and less expensive to build.

At the target average reservoir temperature of between about 120° C. and about 160° C., little or no generation of $H_2S$ or $CO_2$ is expected. Thus, less $H_2S$ and less $CO_2$ is produced per unit of produced bitumen or heavy oil than for a typical SAGD project.

TAGD may be used to supplement existing SAGD operations or may be used as a retrofit existing SAGD well bores.

In the preceding description, for purposes of explanation, numerous details are set forth in order to provide a thorough understanding of the embodiments. However, it will be apparent to one skilled in the art that these specific details are not required. The above-described embodiments are intended to be examples only. Alterations, modifications and variations can be effected to the particular embodiments by those of skill in the art without departing from the scope, which is defined solely by the claims appended hereto.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A method for producing bitumen or heavy oil from a reservoir, the method comprising:

a) defining at least one lateral section of the reservoir for placement of patterns of heater wells above a producer well;

b) placing the producer well at a substantially centered location at or adjacent to the bottom of the reservoir within each of the lateral sections;

c) placing a triangular pattern of heater wells above the producer well;

d) placing a regular or non-regular pentagonal pattern of heater wells, or a portion thereof, at or above the triangular pattern of heater wells;

e) heating the reservoir with the triangular and pentagonal patterns of heater wells to conductively heat the reservoir and reduce the viscosity of the bitumen or heavy oil; and f) producing bitumen or heavy oil with the producer well.

2. The method of claim 1 wherein the triangular pattern is arranged with a lowermost vertex located above and substantially aligned with the producer well and the heater wells of the remaining two higher vertices of the triangular pattern are contained within the boundaries of the lateral section at substantially the same level above the lowermost vertex of the triangular pattern.

3. The method of claim 2 wherein an additional heater well is placed substantially centrally within the pentagonal pattern.

4. The method of claim 2 wherein the width of the lateral section is between about 35 m to about 65 m.

5. The method of claim 2 wherein the reservoir thickness is less than about 50 m and the pentagonal pattern includes, as its lowest side, the heater wells of the two higher vertices of the triangular pattern and wherein the adjacent vertices of the pentagonal pattern extending laterally from the lowest side are located at or adjacent to the boundaries of the lateral section.

6. The method of claim 2 wherein the pentagonal pattern is a complete regular or non-regular pentagonal pattern and the apex of the pentagonal pattern is substantially aligned with the producer well.

7. The method of claim 2 wherein the bitumen or heavy oil drains by gravity from an upper portion of the lateral section into the producer well in a generally triangular profile.

8. The method of claim 1 wherein the reservoir thickness is greater than about 50 m and the pentagonal pattern is elevated above the triangular pattern and oriented with its lowermost vertex substantially aligned with the heater well.

9. The method of claim 8 wherein an additional heater well is placed substantially centrally within the pentagonal pattern.

10. The method of claim 8 wherein the distance between the top of the triangular pattern and the lowermost vertex of the pentagonal pattern is between about 2 m to about 20 m.

11. The method of claim 8 wherein the adjacent vertices of the pentagonal pattern extending laterally from the lowermost vertex are located at or adjacent to the boundaries of the lateral section.

12. The method of claim 8 wherein the pentagonal pattern is a complete pentagonal pattern with uppermost vertices contained within the boundaries of the lateral section.

13. The method of claim 8 wherein the bitumen or heavy oil drains vertically by gravity from an upper portion of the lateral section into the producer well in the pentagonal pattern which narrows into radial inflow in the triangular pattern.

14. The method of claim 8 wherein the reservoir thickness exceeds 100 m and additional successively elevated regular or non-regular pentagonal patterns of heater wells are placed above the pentagonal pattern located above the triangular pattern.

15. The method of claim 14 wherein an additional heater well is placed substantially centrally within each of the pentagonal patterns.

16. The method of claim 14 wherein the bitumen or heavy oil drains vertically by gravity from an upper portion of the lateral section into the producer well which narrows into radial inflow in the pentagonal pattern located above the triangular pattern.

17. The method of claim 14 wherein at least one higher pentagonal pattern is arranged such that it shares two vertices with the preceding lower pentagonal pattern.

18. A method for producing bitumen or heavy oil from a reservoir, the method comprising:

a) dividing at least a portion of the reservoir into a plurality of lateral sections;

b) placing a producer well at a substantially centered location at or adjacent to the bottom of the reservoir within each of the lateral sections;

c) placing a triangular pattern of heater wells above each producer well;

d) placing a regular or non-regular pentagonal pattern of heater wells, or a portion thereof, at or above each triangular pattern of heater wells;

e) heating the reservoir with the triangular and pentagonal patterns of heater wells to conductively heat the reservoir and reduce the viscosity of the bitumen or heavy oil; and f) producing bitumen or heavy oil with the producer well of each lateral section.

19. The method of claim 18 further comprising: g) placing a second pentagonal pattern of heater wells, or a portion thereof, at or above the pentagonal pattern of heater wells placed in step d).

20. The method of claim 18 wherein at least one heater well of the pentagonal pattern of heater wells of one lateral section is shared by an adjacent pentagonal pattern of heater wells in an adjacent lateral section.

* * * * *